US006986443B2

(12) United States Patent
Laible

(10) Patent No.: US 6,986,443 B2
(45) **Date of Patent: *Jan. 17, 2006**

(54) DOSING AND/OR DISPENSING SYSTEM

(76) Inventor: Rodney Laible, 16315 Pawnee Rd., Bennington, NE (US) 68007

( * ) Notice: Subject to any disclaimer, the term of this patent is extended or adjusted under 35 U.S.C. 154(b) by 8 days.

This patent is subject to a terminal disclaimer.

(21) Appl. No.: 10/835,427

(22) Filed: Apr. 29, 2004

(65) Prior Publication Data

US 2004/0206786 A1 Oct. 21, 2004

Related U.S. Application Data

(63) Continuation-in-part of application No. 10/736,962, filed on Dec. 17, 2003, which is a continuation-in-part of application No. 10/685,549, filed on Oct. 15, 2003, which is a continuation-in-part of application No. 10/372,375, filed on Feb. 22, 2003, which is a continuation-in-part of application No. 10/074,469, filed on Feb. 12, 2002, now abandoned.

(51) Int. Cl.
*B67D 5/06* (2006.01)

(52) U.S. Cl. ..... 222/181.1; 222/189.09; 222/481.5; 222/518

(58) Field of Classification Search ..... 222/181.1, 222/189.09, 185.1, 481.5, 518
See application file for complete search history.

(56) References Cited

U.S. PATENT DOCUMENTS

| | | | | |
|---|---|---|---|---|
| 3,123,107 | A * | 3/1964 | Kappler | 141/352 |
| 4,401,272 | A | 8/1983 | Merton et al. | 239/337 |
| 5,048,723 | A | 9/1991 | Seymour | 222/81 |
| 5,350,091 | A | 9/1994 | Leete et al. | 222/529 |
| 5,368,025 | A | 11/1994 | Young et al. | 222/189.06 |
| 5,472,124 | A | 12/1995 | Martushev | 222/529 |
| 5,526,961 | A * | 6/1996 | Burrows | 222/185.1 |
| 5,988,456 | A | 11/1999 | Laible | 222/464.1 |
| 6,062,435 | A | 5/2000 | Hess, III | 222/175 |
| 6,155,464 | A * | 12/2000 | Vachon | 222/484 |
| 6,299,037 | B1 | 10/2001 | Lee | 222/518 |
| 6,648,180 | B2 * | 11/2003 | Moon et al. | 222/185.1 |

* cited by examiner

*Primary Examiner*—Joseph A. Kaufman
(74) *Attorney, Agent, or Firm*—Thomte, Mazour & Neibergall; Dennis L. Thomte

(57) ABSTRACT

A dosing and/or dispensing system for use with a liquid container such as a bottle or the like for dosing and/or dispensing liquid contents from the bottle. Various different dosing and/or dispensing embodiments are disclosed which enable the liquid to be dosed or dispensed by gravity from the container.

9 Claims, 25 Drawing Sheets

DOSING AND/OR DISPENSING SYSTEM

CROSS-REFERENCE TO RELATED APPLICATION

This is a continuation-in-part application of Petitioner's earlier application Ser. No. 10/736,962 filed Dec. 17, 2003, entitled A DOSING AND/OR DISPENSING SYSTEM which is a continuation-in-part application of Petitioner's earlier application Ser. No. 10/685,549 filed Oct. 15, 2003, entitled A DISPENSING SYSTEM which is a continuation-in-part application of Petitioner's earlier application Ser. No. 10/372,375 filed Feb. 22, 2003, entitled CLOSED LOOP DISPENSING SYSTEM, which is a continuation-in-part application of Petitioner's earlier application Ser. No. 10/074,469 filed Feb. 12, 2002 now abandoned, entitled CLOSED LOOP DISPENSING SYSTEM WITH METERING ORIFICE.

BACKGROUND OF THE INVENTION

1. Field of the Invention

The invention disclosed in Petitioner's earlier application Ser. No. 10/736,962 filed Dec. 17, 2003, relates to a dosing and/or dispensing system. The invention disclosed in Petitioner's earlier application Ser. No. 10/685,549 filed Oct. 14, 2003, relates to a dispensing system, which may be either an open loop or closed loop dispensing system, and more particularly to a dispensing system for dispensing corrosive liquid chemicals or dangerous medical liquid products which are typically drawn from the upper end of a container, such as a bottle or the like, to a mixing machine or the like. In that invention, the container is inverted with the liquid product gravity flowing from the lower end thereof. Further, the dispensing system of that invention provides a means for venting the container during shipment or storage in those situations where the liquid within the container requires venting. In the dosing and/or dispensing system of application Ser. No. 10/736,962 filed Dec. 17, 2003, three dosing and/or dispensing embodiments are disclosed which are ideally suited for use with portions of the invention of Ser. No. 10/685,549 filed Oct. 14, 2003. In application Ser. No. 10/777,916 filed Feb. 12, 2004, other dosing and/or dispensing embodiments are disclosed which are ideally suited for use with portions of the invention of Ser. No. 10/685,549 filed Oct. 14, 2003. In the instant invention, a modified version of the dosing and/or dispensing system is described.

2. Description of the Related Art

Corrosive liquid chemicals and dangerous medical liquid products are typically contained in a container such as a bottle or the like and are frequently dispensed therefrom to a mixing machine. Normally, a cap is placed on the bottle with a dip tube extending therefrom downwardly into the interior of the bottle for drawing the liquid upwardly thereinto. Normally, a dispensing tube extends from the cap to a mixing machine or some other piece of equipment which creates suction in the dispensing tube to draw the liquid from the interior of the bottle. In some prior art devices, when the suction or vacuum is removed from the dispensing tube, backflow may occur. Further, when the cap is removed from the bottle, backflow from the dispensing tube may also occur. Additionally, when the cap is removed from the bottle, liquid residue in the bottle may spill therefrom. Additionally, the conventional prior art systems normally do not prevent the re-use of the bottle which is prohibited in some cases. Yet another disadvantage of the prior art is that a reliable and efficient venting means for the bottle is not normally provided for relieving vacuum pressure from within the bottle. The system of co-pending application Ser. No. 10/372,375 solved the problems associated with the prior art devices or systems.

While the system of co-pending application Ser. No. 10/372,375 works extremely well when the container is in its normal upright condition, the system may not perfectly function when the container of the co-pending application is inverted. When the container or bottle of co-pending application Ser. No. 10/372,375 is inverted, the liquid in the container is drawn or discharged from the normal upper end of the container but which is the lower end of the container in the inverted position. In such a position, the venting membrane, which would normally permit ambient air to replace the liquid in the container as the liquid is discharged from the container, may become "clogged" due to the liquid coming into contact therewith and crystallizing thereon. If air is not permitted to enter the container as the liquid is drawn therefrom, a partial vacuum is created in the upper end of the inverted container which will interfere with the discharge of the liquid therefrom.

The system of co-pending application Ser. No. 10/372,375 solved the problems of the prior art and represented an improvement in the invention of co-pending application Ser. No. 10/074,469. The invention of application Ser. No. 10/685,549 filed Oct. 14, 2003, represents an improvement over the invention described in co-pending application Ser. No. 10/372,375. The invention disclosed in application Ser. No. 10/736,962 filed Dec. 17, 2003, represented an improvement over the invention disclosed in the co-pending application Ser. No. 10/685,549 filed Oct. 14, 2003.

The system of application Ser. No. 10/777,916 discloses other embodiments of the dosing and/or dispensing system of the application Ser. No. 10/736,962 filed Dec. 17, 2003. The instant invention does not require an insert for the container.

SUMMARY OF THE INVENTION

This invention relates to a dosing and/or dispensing system for use with a container, such as a bottle or the like, having an outlet opening formed in the upper end thereof. A cap is removably mounted on the container for selectively closing the outlet opening during shipment and storage. In use, the container is positioned in an inverted position. The lower end of the inverted container has a hollow throat extending downwardly therefrom which has interior and exterior surfaces. The upper end of a dosing and/or dispensing cup has a connector which is secured to the throat of the container such as by a thread connection, a snap-on connection or a snap-in connection. The upper end of the cup has a central opening formed therein below the connector of the cup which is in fluid communication with the interior of the throat of the container. The upper end of the cup, outwardly of the connector, has at least one vent opening formed therein which is in communication with ambient air. A normally closed poppet valve is positioned in the vent opening and has its lower end positioned within the cup. The hollow cup has a valve seat formed therein above its lower end and has a central opening in its lower end below the valve seat. A lift valve, having upper and lower ends, is vertically movably mounted on the lower end of the cup and is movable between upper and lower positions. The lift valve is provided with a valve stem which is slidably received by the central opening in the lower end of the cup. The valve stem has a closed upper end and a lower end. The valve stem has a liquid passageway formed therein below its closed upper end and has a valve on its upper end which closes the valve seat when the lift valve is in its lower position. The liquid passageway is positioned below the valve seat when the lift valve is in its lower position and which is positioned above the valve seat when the lift valve is in its upper position. A vent actuator, movable between upper and lower positions, is operatively secured to the upper end of the valve for movement therewith and is positioned above the valve seat. The vent actuator includes a flat plate at its upper end which is adapted to engage the lower end of the poppet valve, to open the same, when the lift valve is in its upper position. The flat plate also seals the opening in the upper end of the cup when the lift valve is in its upper position.

When the lift valve is moved to its upper position, liquid in the cup flows through the liquid passageway in the valve stem and downwardly through the valve stem and into a suitable container, bottle, etc. When the lift valve moves towards its upper position, the vent actuator is moved toward its upper position so that the flat plate opens the poppet valve to permit ambient air to enter the interior of the cup and move upwardly into the inverted liquid container. When the lift valve reaches its upper position, the flat plate seals the opening in the upper end of the cup to prevent liquid passing from the container into the cup. When the lift valve is returned to its lower position, the valve closes the valve seat and the poppet valve closes the vent opening. The adapter may be mounted in a fixture if desired.

It is therefore a principal object of the invention to provide an improved dosing and/or dispensing system for corrosive or dangerous liquids contained in a container such as a bottle or the like, when the container is positioned in an inverted condition.

Still another object of the invention is to provide an improved dosing and/or dispensing system of the type described which permits sufficient ambient air to enter the interior of the container to replace the liquid being dispensed therefrom so that a vapor lock is prevented.

Still another object of the invention is to provide a dosing and/or dispensing system which is safe and convenient to use.

Yet another object of the invention is to provide dosing and/or dispensing systems representing an improvement in the prior art.

Yet another object of the invention is to provide a dosing and/or dispensing system which is reliable in use.

Still another object of the invention is to provide a dosing and/or dispensing system which eliminates the need for an insert positioned within the throat of the container.

Yet another object of the invention is to provide a dosing and/or dispensing system which may be placed in a bracket or simply attached to the container.

These and other objects will be obvious to those skilled in the art.

BRIEF DESCRIPTION OF THE DRAWINGS

FIGS. 1–22 illustrate the embodiments of application Ser. No. 10/736,962 filed Feb. 12, 2004, wherein:

FIG. 1 is a perspective view of a container in an inverted position so as to dispense liquids;

FIG. 2 is a perspective view of a throat plug assembly illustrating the throat plug in the position when the container is inverted;

FIG. 3 is a perspective view of the throat plug assembly with the throat plug assembly being illustrated in the position when the container is in its upright condition;

FIG. 4 is an exploded perspective view of the throat plug assembly of FIG. 2;

FIG. 5 is a partial vertical sectional view of the container in an upright condition illustrating the manner in which the throat plug assembly and cap permit venting of vapor pressure within the container;

FIG. 6 is a partial exploded perspective view of the container and cap in an upright condition;

FIG. 7 is an exploded perspective view of one means of mounting the inverted container at a dispensing location;

FIG. 8 is an exploded perspective view illustrating an inverted container and its relationship to the structure of FIG. 7;

FIG. 9 is a vertical sectional view of the apparatus of FIG. 8;

FIG. 10 is a view similar to FIG. 9 except that the container has been mounted on the receptacle at the dispensing location;

FIG. 11 is a perspective view illustrating a lever operated, gravity flow control assembly for use with the reservoir of FIG. 7;

FIG. 12 is a vertical sectional view illustrating the assembly of FIG. 11 mounted on the reservoir of FIG. 7;

FIG. 13 is a perspective view of a manual dosing dispenser mounted on a reservoir;

FIG. 14 is a vertical sectional view of the dispenser of FIG. 13;

FIG. 15 is a perspective view of another dosing dispenser;

FIG. 16 is a vertical sectional view of the dispenser of FIG. 15;

FIG. 17 is a perspective view illustrating the embodiment of this invention and its relationship to a liquid container;

FIG. 18 is a perspective view illustrating the embodiment of this invention in its operative position;

FIG. 19 is a sectional perspective view of the embodiment of FIG. 18;

FIG. 20 is a sectional view of the embodiment of FIG. 18 in combination with the throat assembly of FIG. 9;

FIG. 21 is a sectional view similar to FIG. 20 except that the lift valve is in its upper (open) position;

FIG. 22 is a sectional view of a modified venting arrangement;

DETAILED DESCRIPTION OF THE INVENTION

FIGS. 1–10 illustrate the invention of co-pending application Ser. No. 10/685,549 filed Oct. 14, 2003. FIGS. 11–16 illustrate the invention of co-pending application Ser. No. 10/736,962 filed Dec. 17, 2003. The following description with respect to the embodiments of FIGS. 1–22 is found in co-pending application Ser. No. 10/777,916 filed Feb. 12, 2004, and is repeated herein to complete the description of the instant claimed invention. FIGS. 23–26 illustrate the embodiment of the instant invention.

Figure 1:
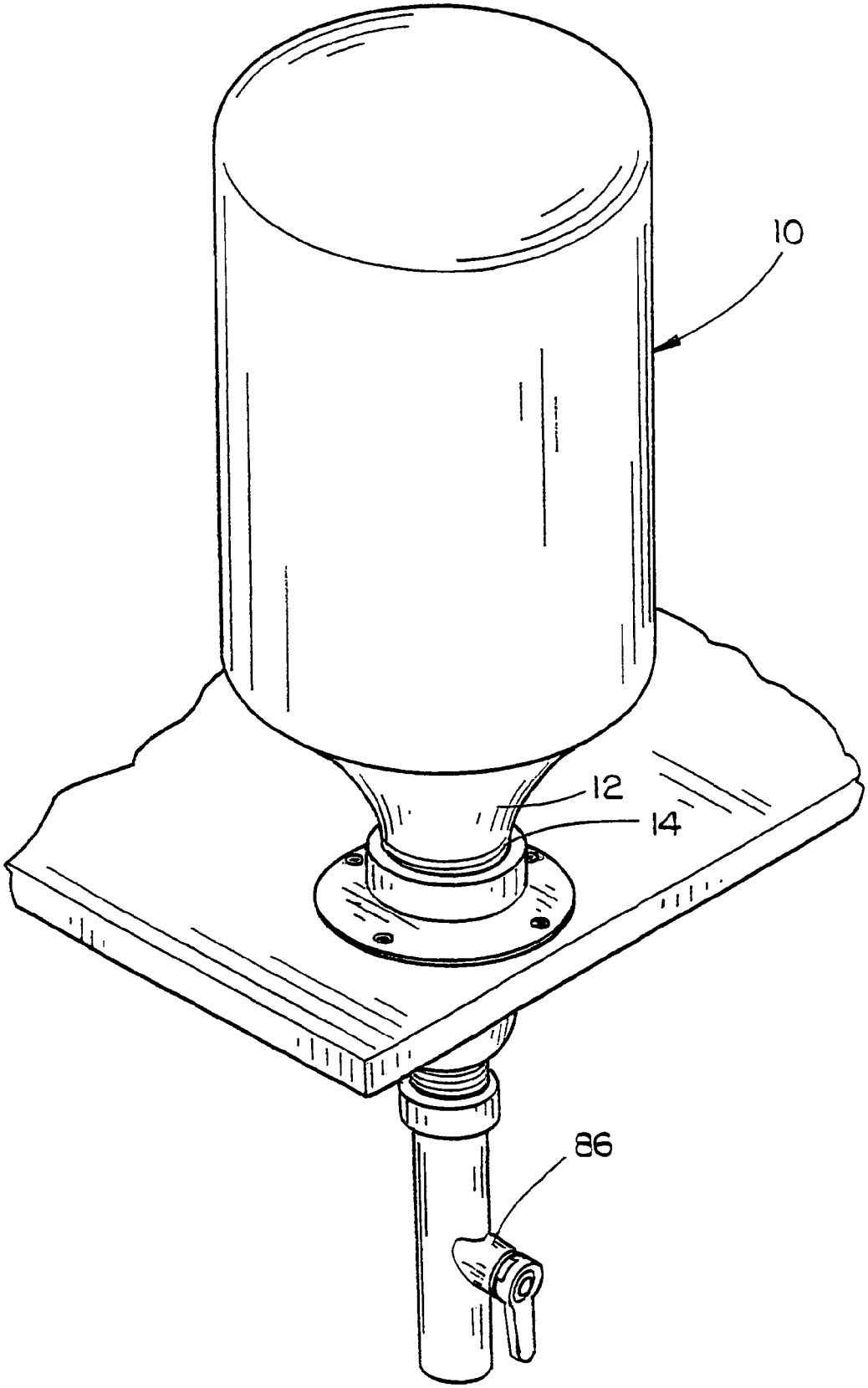
Figure 3:
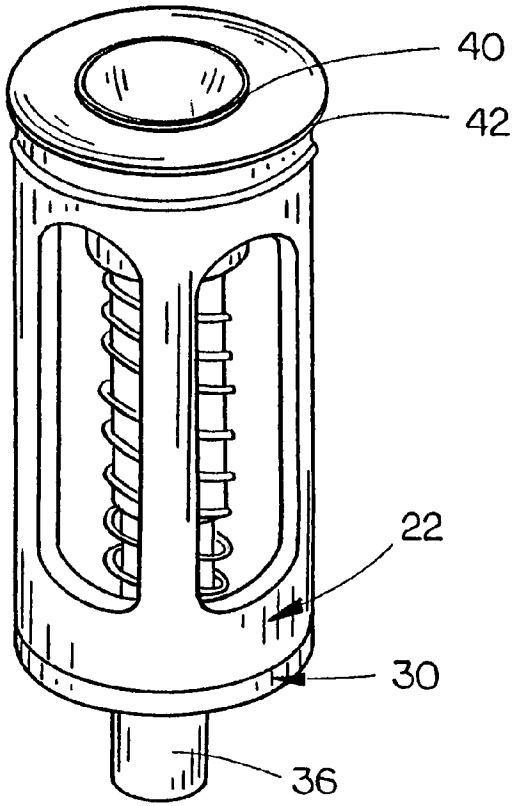

In FIGS. 1–10, the numeral 10 refers to a conventional container such as a bottle or the like which is used for transporting, storing and dispensing liquids therefrom. FIG. 1 illustrates the container 10 in an inverted dispensing position. Container 10 includes a hollow throat portion 12 extending downwardly therefrom and which has external threads 14 mounted thereon.

Figure 2:
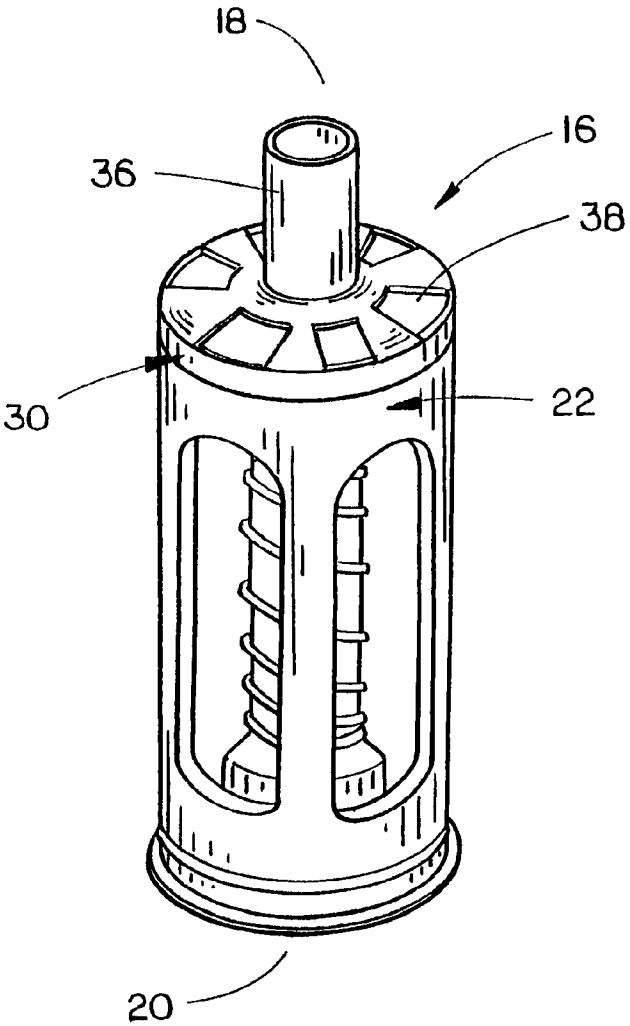
Figure 4:
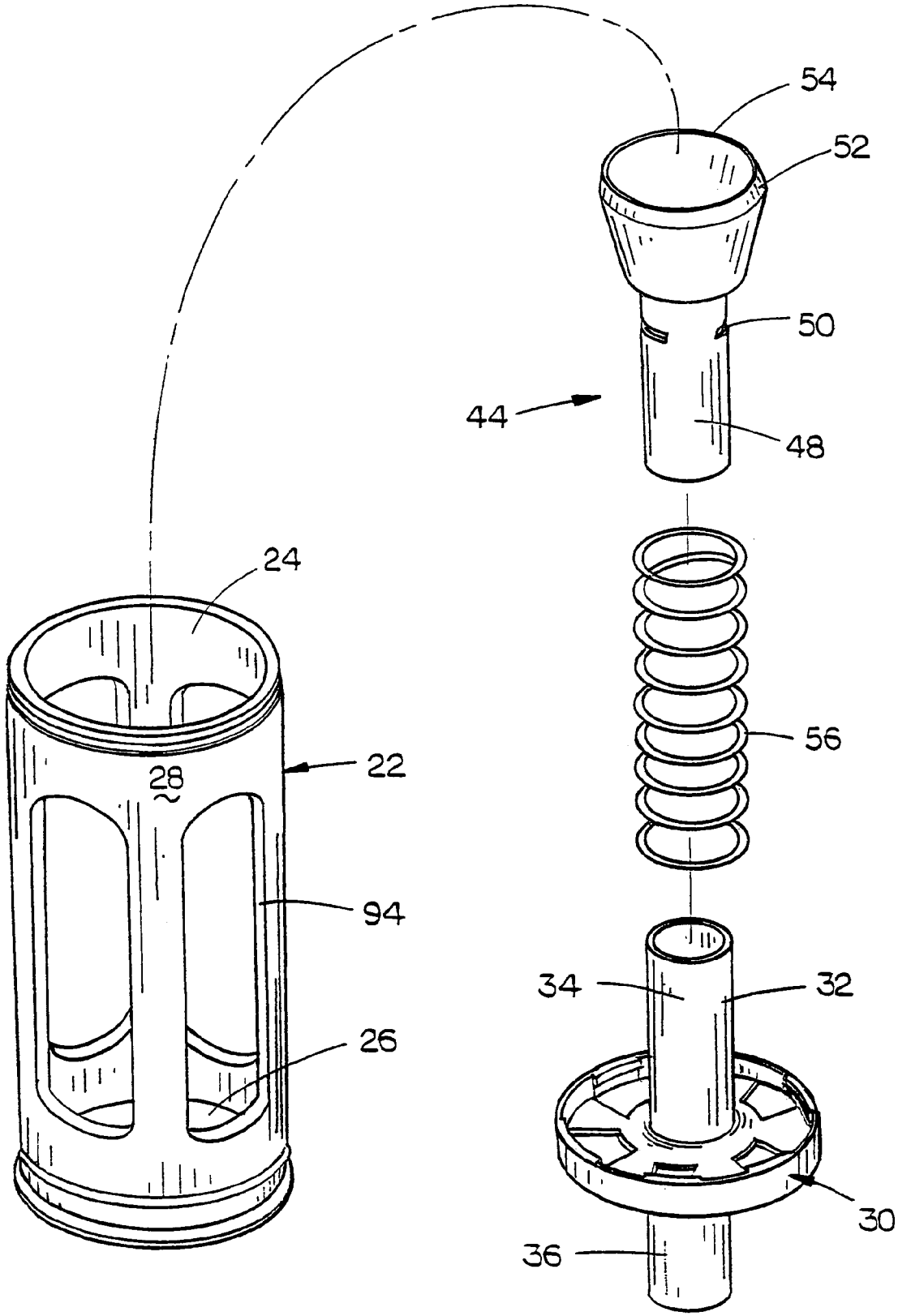

The numeral 16 refers to a throat plug assembly which will be described as it is positioned when the container 10 is in the inverted position. The throat plug assembly 16 is inserted into the hollow throat portion 12 of the container 10 while the container 10 is in its upright position. For purposes of description, throat plug assembly 16 will be described as including an upper end 18 and a lower end 20. The lower end 20 of the throat plug assembly 16 includes a hollow cylindrical plug member 22 having an open upper end 24, an open lower end 26, and a cylindrical wall portion 28 extending therebetween. A disk-like tube support 30 is detachably mounted on the upper end of the cylindrical wall portion 28, preferably by means of a snap-fit connection. Tube support 30 includes a tube 32 having a lower end portion 34 and an upper end portion 36. As seen in the drawings, lower end portion 34 extends downwardly from tube support 30 and upper end portion 36 extends upwardly from tube support 30. In some cases, upper end portion 36 will not be needed. In some cases, a flexible tube (not shown) will be secured to the upper end of upper tube portion 36 so as to extend upwardly into the container 10, if so required. As seen in FIG. 2, tube support 30 has a plurality of spaced-apart passageways 38 formed therein.

Figure 5:
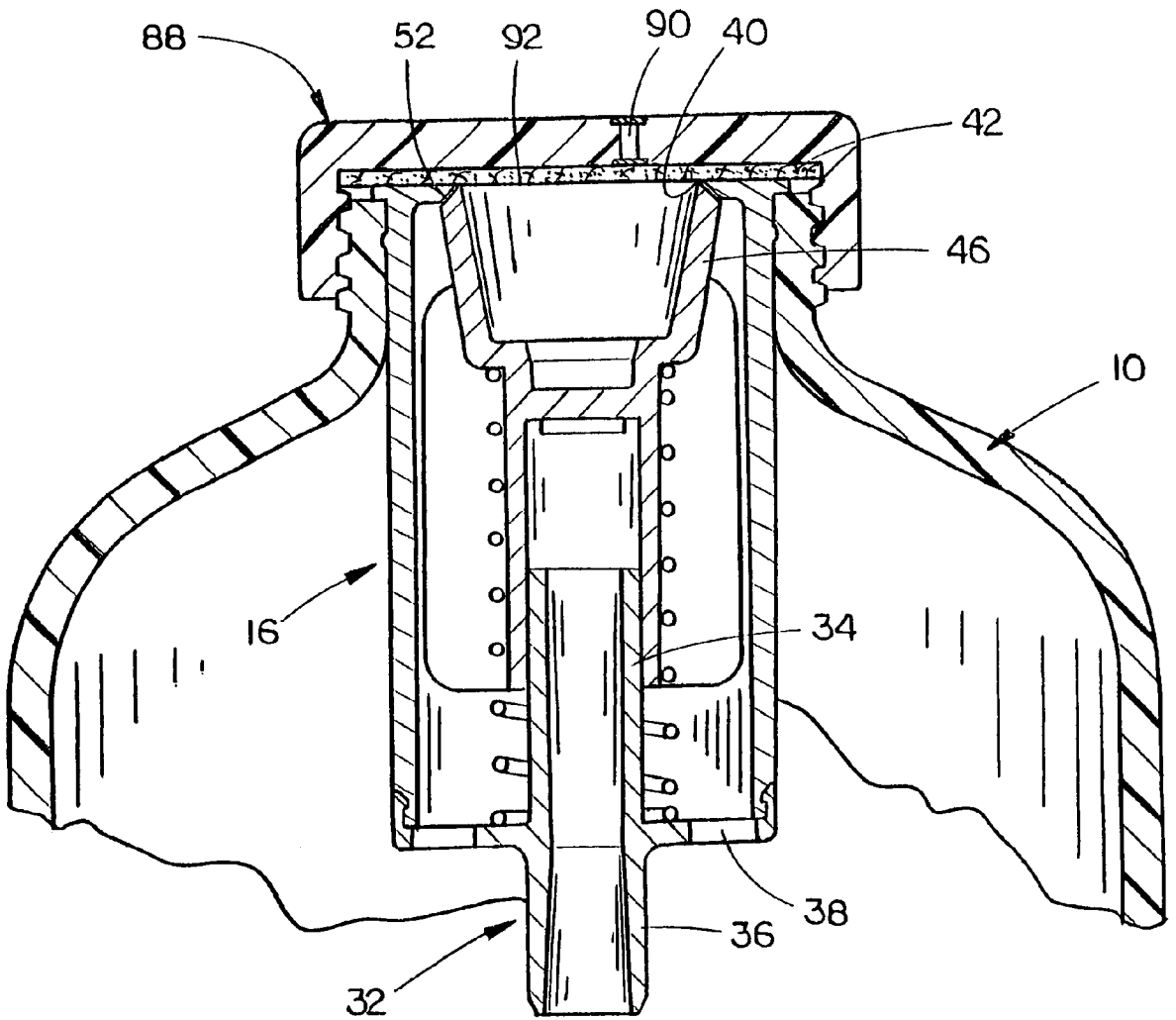
Figure 6:
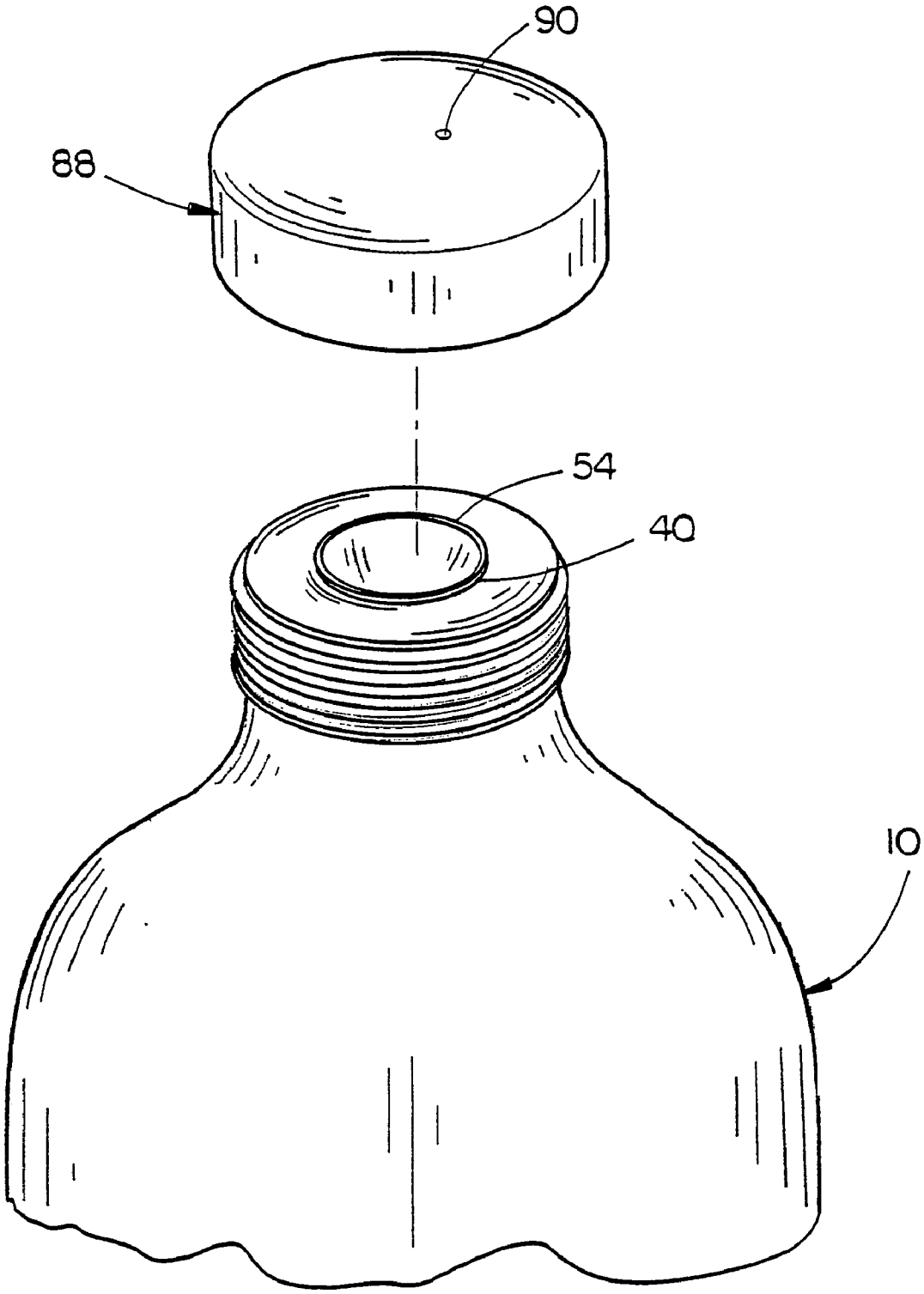

The lower end of the plug member 22 defines a centrally located opening which defines a valve seat 40. The lower end of plug member 22 also has an outwardly extending lip portion 42 which is designed to engage the upper end of the container 10, as seen in FIG. 5, to limit the downward movement of the throat plug assembly 16 with respect to container 10 when the throat plug assembly 16 is inserted downwardly into the container 10 while the container is in its upright position (FIG. 5).

Figure 9:
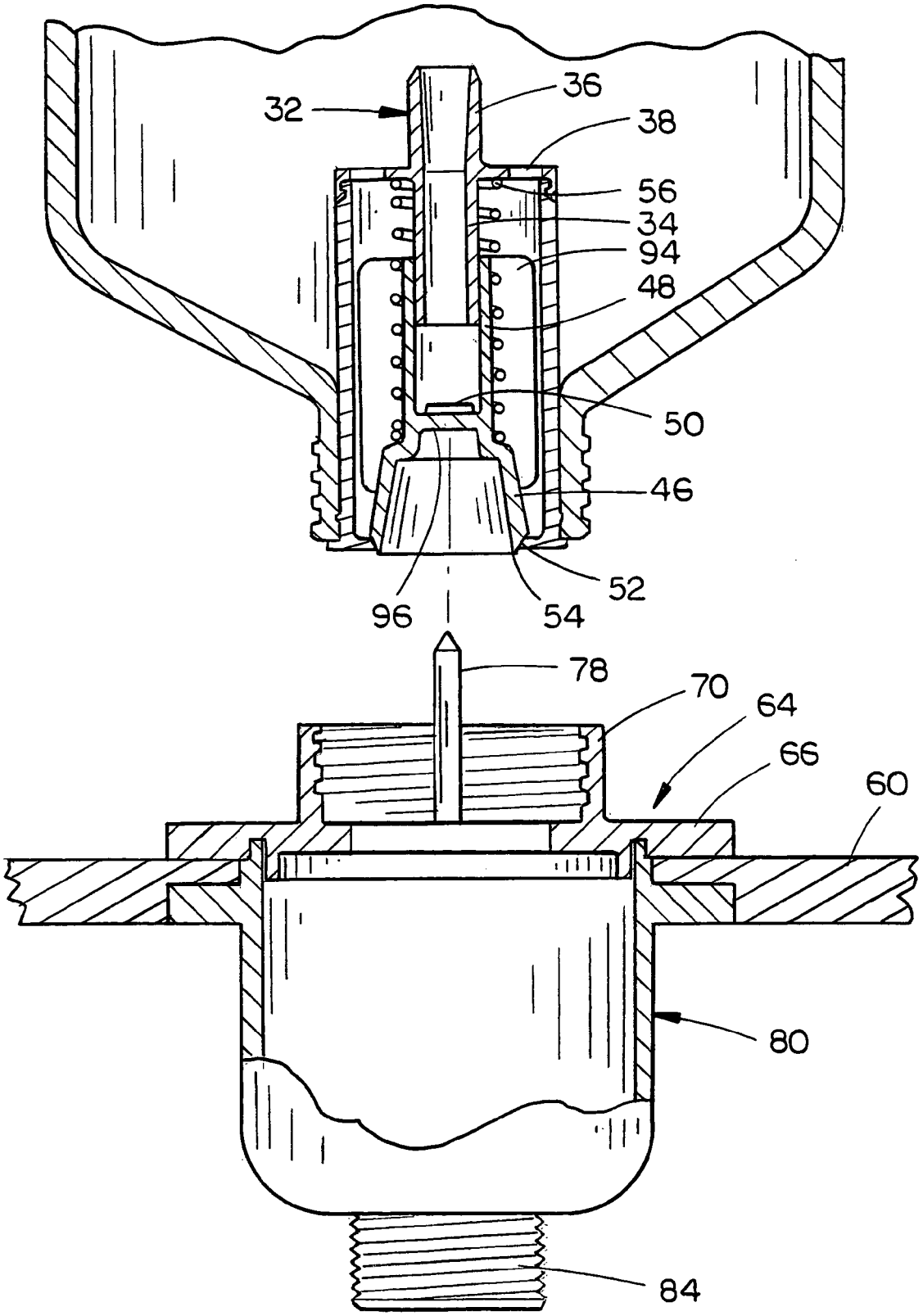
Figure 10:
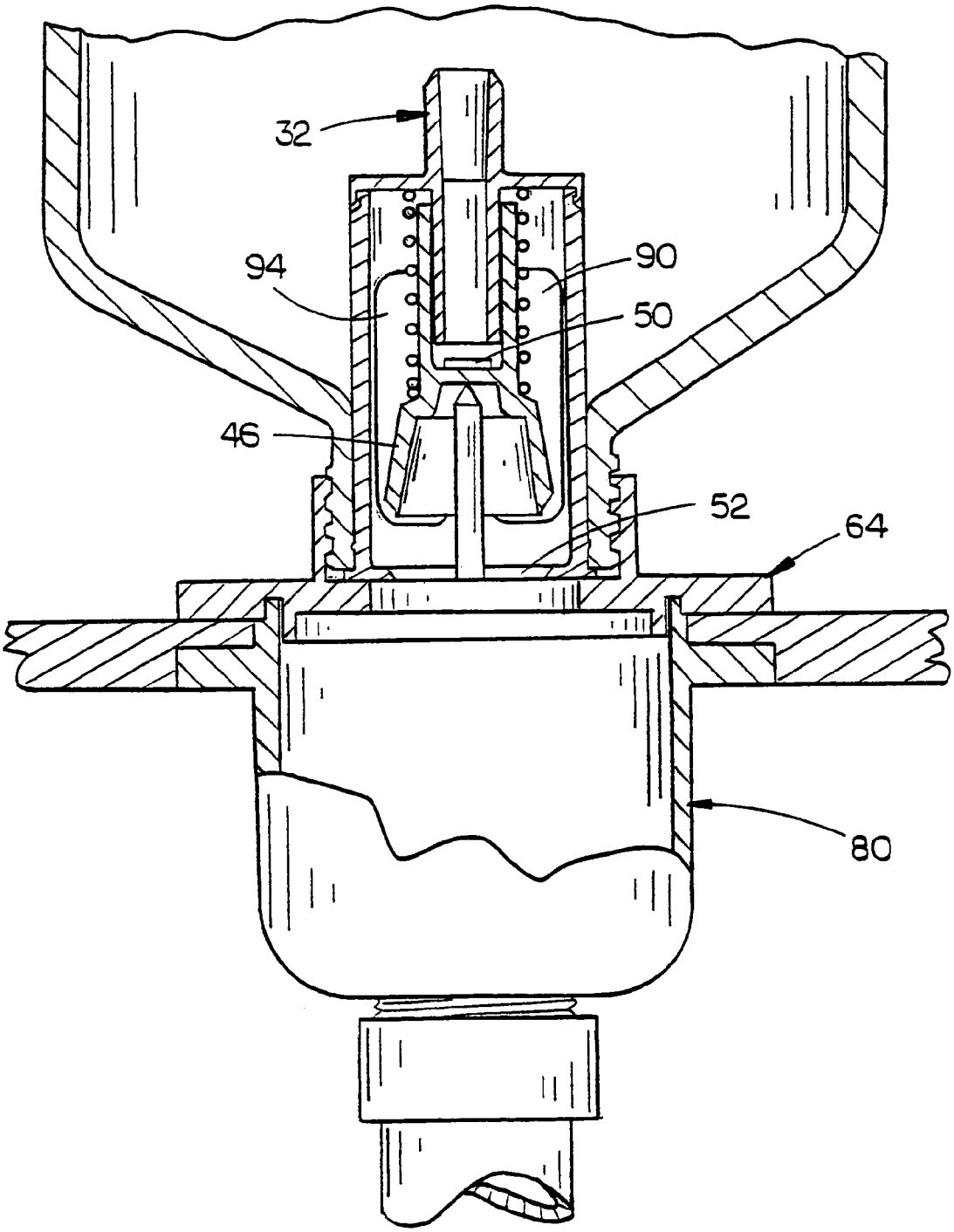

The numeral 44 refers generally to a valve means which is movably positioned within the plug member 22 and which includes a normally closed valve 46 and a hollow valve stem 48 extending upwardly therefrom. Valve stem 48 includes one or more passageways 50 extending therethrough. Valve 46 includes a tapered portion 52 at its lower end which terminates in a lower end portion 54. In those cases where the container contains liquids requiring venting during storage or shipment, the lower end portion 54 will protrude slightly downwardly from the lower end of plug member 22, as illustrated in FIG. 9. Valve stem 48 slidably receives the lower end of lower end portion 34 of tube 32, as illustrated in FIG. 9. Spring 56 embraces valve stem 48 and lower end portion 34 to yieldably urge valve 46 to its lower closed position.

Figure 7:
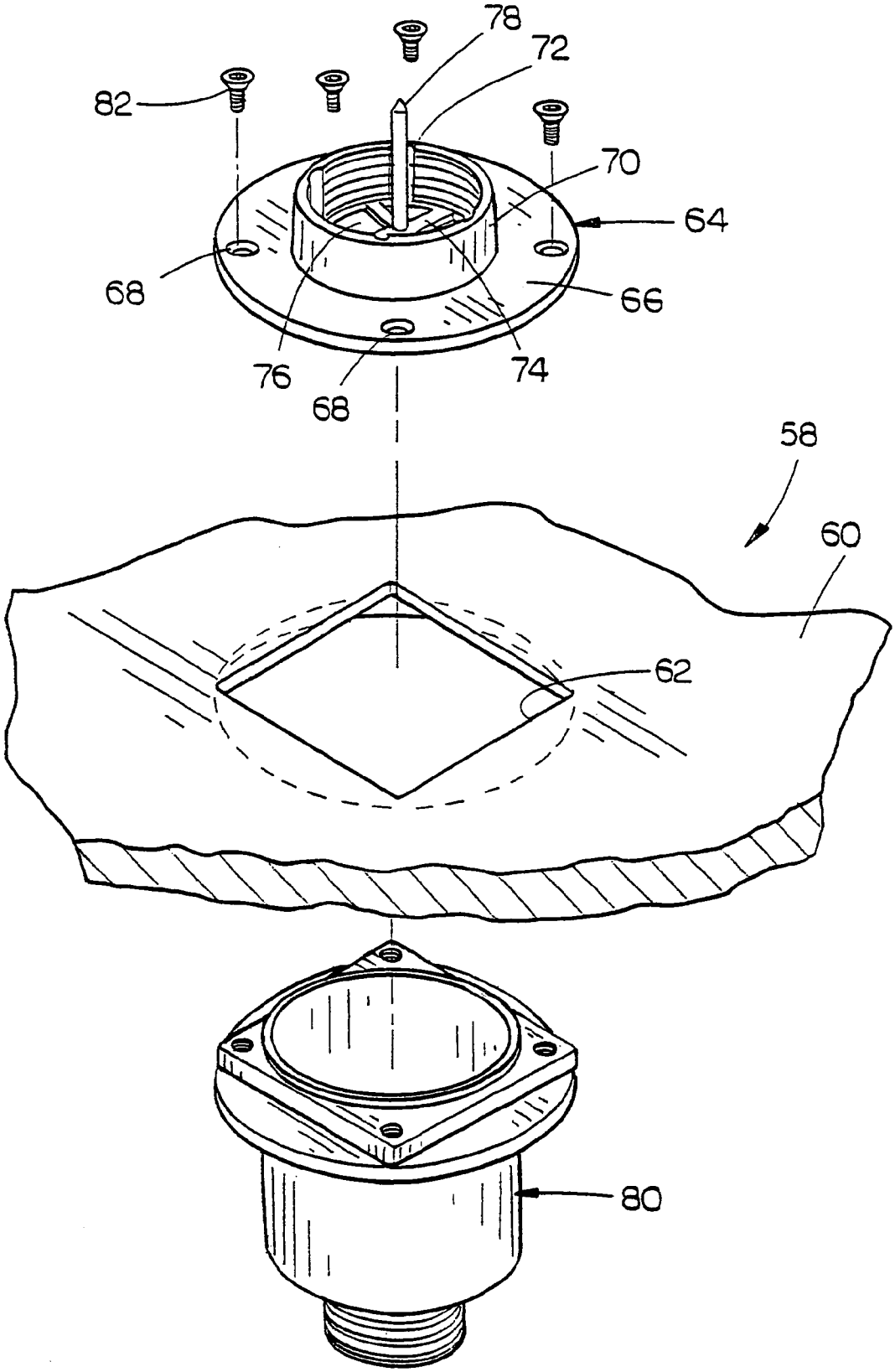
Figure 8:
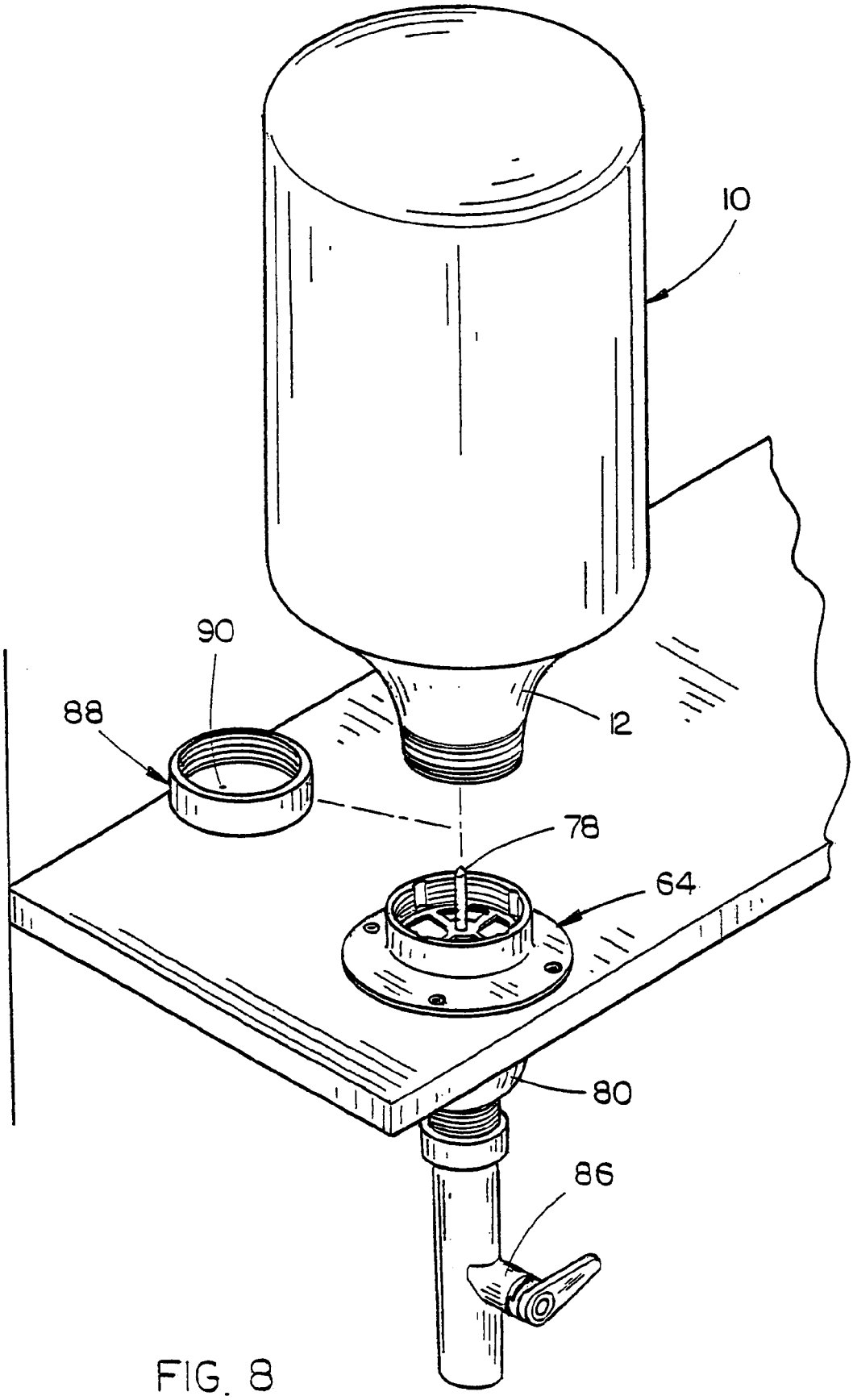

FIGS. 7–9 illustrate portions of a dispensing station which is referred to generally by the reference numeral 58. Dispensing station 58 may be located within a cabinet or simply upon a horizontally disposed board or shelf 60 having an opening 62 formed therein. Included at the dispensing station 58 is an upper fixture 64 which includes a flange 66 having screw or bolt openings 68 formed therein. The fixture 64 includes an upwardly extending internally threaded stub 70. The interior of pipe stub 70 is provided with a plurality of longitudinally extending grooves or passageways formed therein. At the lower inner end of stub 70 are a plurality of support arms 74 which extend across the opening 76 and which have an actuator rod 78 secured thereto and extending upwardly therefrom.

A lower fixture 80 is positioned below the shelf and within the shelf 60, as illustrated in FIGS. 7 and 9. Screws 82 secure the fixtures 64 and 80 together, as seen in FIG. 7. Preferably, the lower end of fixture 80 includes an externally threaded throat portion 84 for dispensing liquid therethrough to an on-off valve 86 or other dispensing or metering device.

When the container 10 is being used to store, transport or dispense liquids which require venting during the shipment or storage thereof, the container 10 will include a vented cap 88 having a vent opening 90 formed therein, the lower end of which is closed by a membrane 92 which permits air to pass therethrough but does not pass liquid to pass therethrough. When the cap 88 is screwed onto the container 10, the membrane 92 will engage the end 54 of valve 46 to slightly open valve 46, as illustrated in FIG. 5, to permit air to be vented from the bottle while preventing liquid from being discharged from the bottle. When valve 46 has been slightly unseated, as illustrated in FIG. 5, vapor pressure within the container 10 may pass through the passageways or openings 94 formed in cylindrical wall member 28 and thence through the opening between the tapered surface 52 of valve 46 and the valve seat 52 and thence through the membrane 92 outwardly through the opening 90. When the throat plug assembly of this invention is not going to be used in situations where it is necessary to vent vapor pressure from the container during shipment or storage, there is no need for the end portion 54 of tapered portion 52 to be included. In that situation, the valve 46 will positively close the valve seat 40. Regardless of whether the end portion 54 is utilized or not, when the cap 88 is removed from the container 10, the valve 46 will close the valve seat 52. The container 10 is then inverted with the external threads 14 of the container 10 being threadably engaged with the internal threads on the stub 70. As the container 10 is threadably mounted into the fixture 64, the actuator rod 78 engages the valve means 44 at 96 which will cause the valve 46 to unseat from the valve seat 52. Although the fixture 64 is shown as including internal threads to effect the connection between the container and the fixture, a push-pull connection could also be utilized. Such a connection is commonly referred to as a snap-in connection.

When it is desired to dispense the liquid from the container 10 into a receptacle, tub, container, etc., the valve 86 is opened to permit liquid to flow through the passageways 94, passageways 50, and through the valve seat 52, through the fixture 64, through fixture 80, and outwardly through the valve 86. Air is permitted to enter the interior of the container 10 to prevent air locks therein during the dispensing of liquids by permitting ambient air to pass downwardly through the passageways 72 in stub 70, thence through passageways 94, passageways 50, and upwardly through the passageway 36 and also through the tube 32 into the interior of the container. Although it is preferred that all of the passageways 50, 94 and 38 be utilized, in some situations it may be only necessary to use the passageways 38 or it may only be necessary to utilize the passageways 94 or it may be only necessary to utilize the passageways 50. If the liquid is very viscous, it may be advantageous to insert a flexible tube onto the upper end of upper end portion 36 so that air passing through the tube 32 will be able to pass through the viscous liquid to the upper end of the container.

Thus the dispensing system of FIGS. 1–10 may be utilized to vent containers or it may be used where venting is not required. The system of FIGS. 1–10 is extremely economical and provides for a continuous gravity flow due to the fact that ambient air can enter the interior of the container to replace the liquid being dispensed therefrom. The dispensing system of FIGS. 1–10 eliminates any possibility of a vapor lock and provides a positive shut-off.

Figure 11:
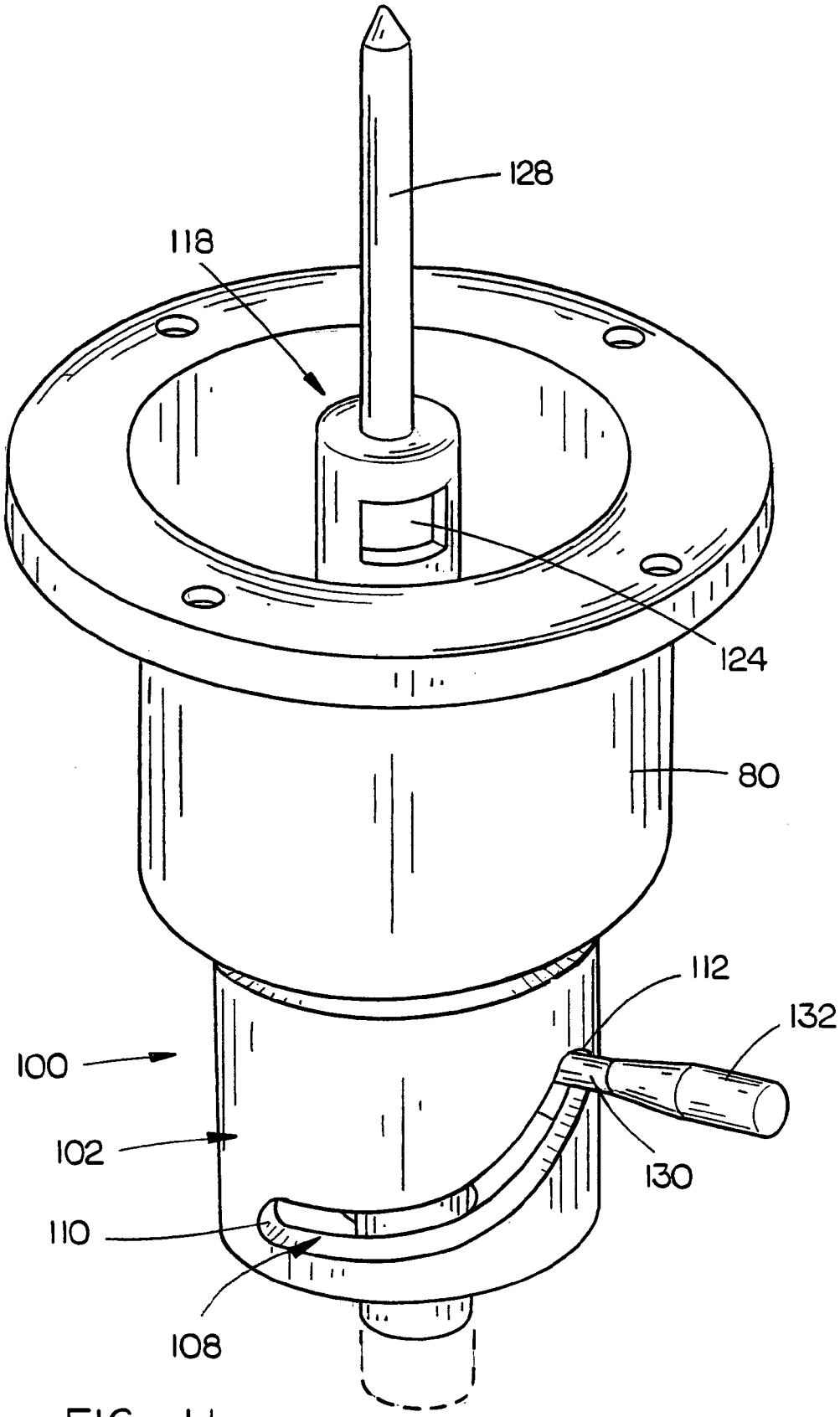
Figure 12:
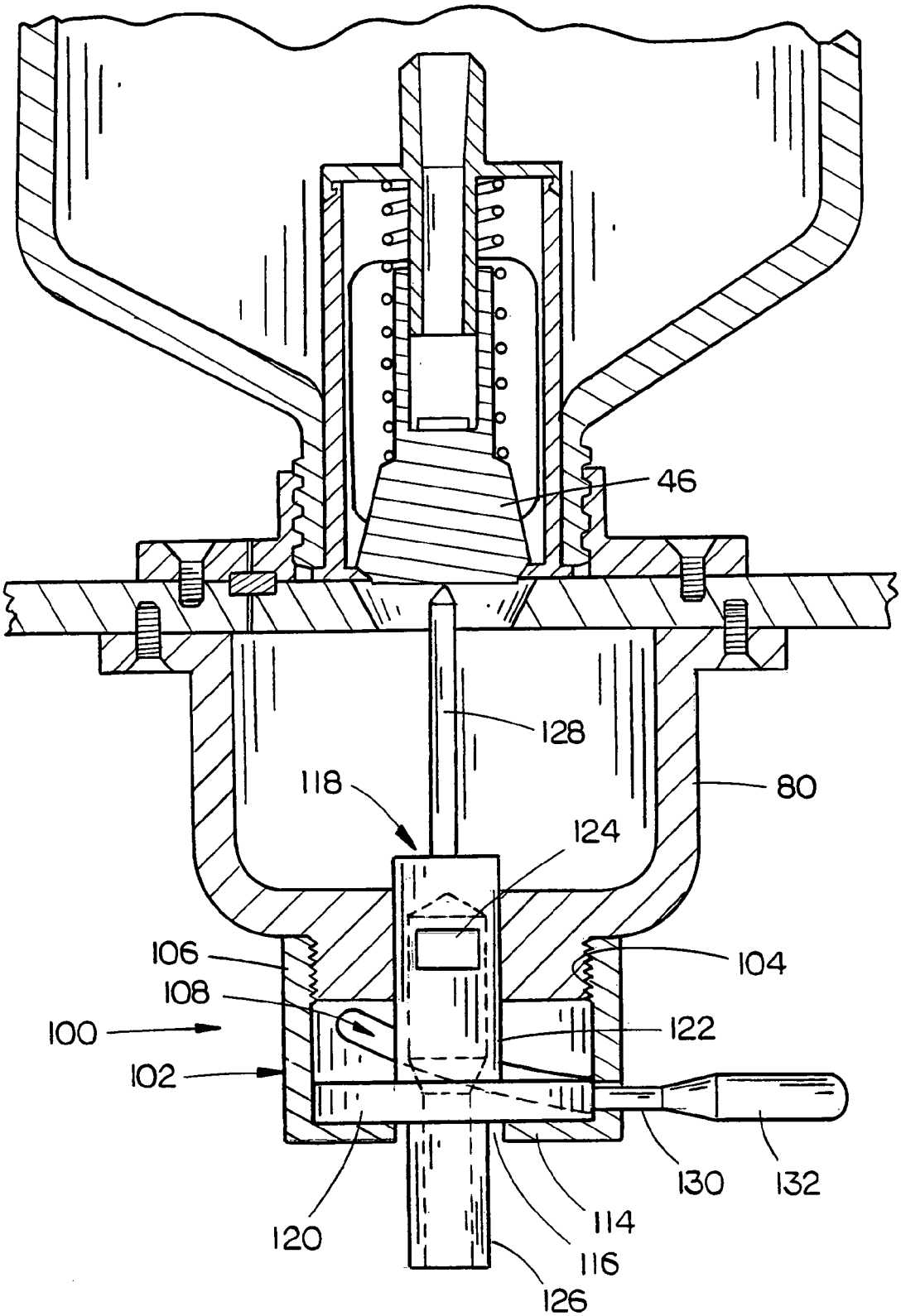

FIGS. 11 and 12 illustrate a lever operated, gravity flow control assembly 100 which may be mounted on the reservoir 80 of FIGS. 1–10. Assembly 100 includes a hollow, cup-shaped housing 102 including an internally threaded upper end 104 which is threadably secured to the lower end of the reservoir 80. Housing 102 includes a cylindrical wall 106 which has an arcuate cam track 108 formed therein which has a lower end 110 and an upper end 112. Housing 102 also includes a bottom wall 114 which has a central opening 116 formed therein.

The numeral 118 refers to a valve actuator assembly which is selectively vertically and rotatably mounted in housing 102 and which extends upwardly through reservoir 80. Assembly 118 includes a disc-shaped member 120 which movably sealably engages the inside surface of wall 106. A hollow tube 122 extends upwardly from member 120 and has one or more openings 124 formed in the wall surface thereof. The inner lower end of tube 122 is in fluid communication with tube 126 which extends downwardly from member 120. Normally, a bottle or the like will be secured to tube 126 to facilitate the flow of liquid from the container into the bottle or the like. However, the tube 126 itself may be used to transfer the fluid into any suitable receptacle. Actuator stem 128 extends upwardly from the upper end of tube 122 through reservoir 80 for selective engagement with the valve 46 to open the same. Lever 130 is secured to the member 120 and extends outwardly through the cam track 108. Preferably, the outer end of the lever 130 has a knob 132 mounted thereon.

When lever 130 is at the lower end 110 of the cam track 108, the valve 46 is in its fully closed position (FIG. 12). To open valve 46, the lever 130 is moved upwardly along the cam track 108 which causes the actuator stem 128 to move upwardly into engagement with the valve 46 to move the same upwardly to open the same. The lever 130 is selectively rotated to achieve the desired flow rate. When the lever 130 is at the lower end 110 of the cam track 108, the container may be removed from the fixture to replace the same since the valve 46 is in its normally closed position of FIG. 12. The container may be screwed onto the fixture, snapped onto the fixture, or lever locked onto the fixture as desired.

Figure 13:
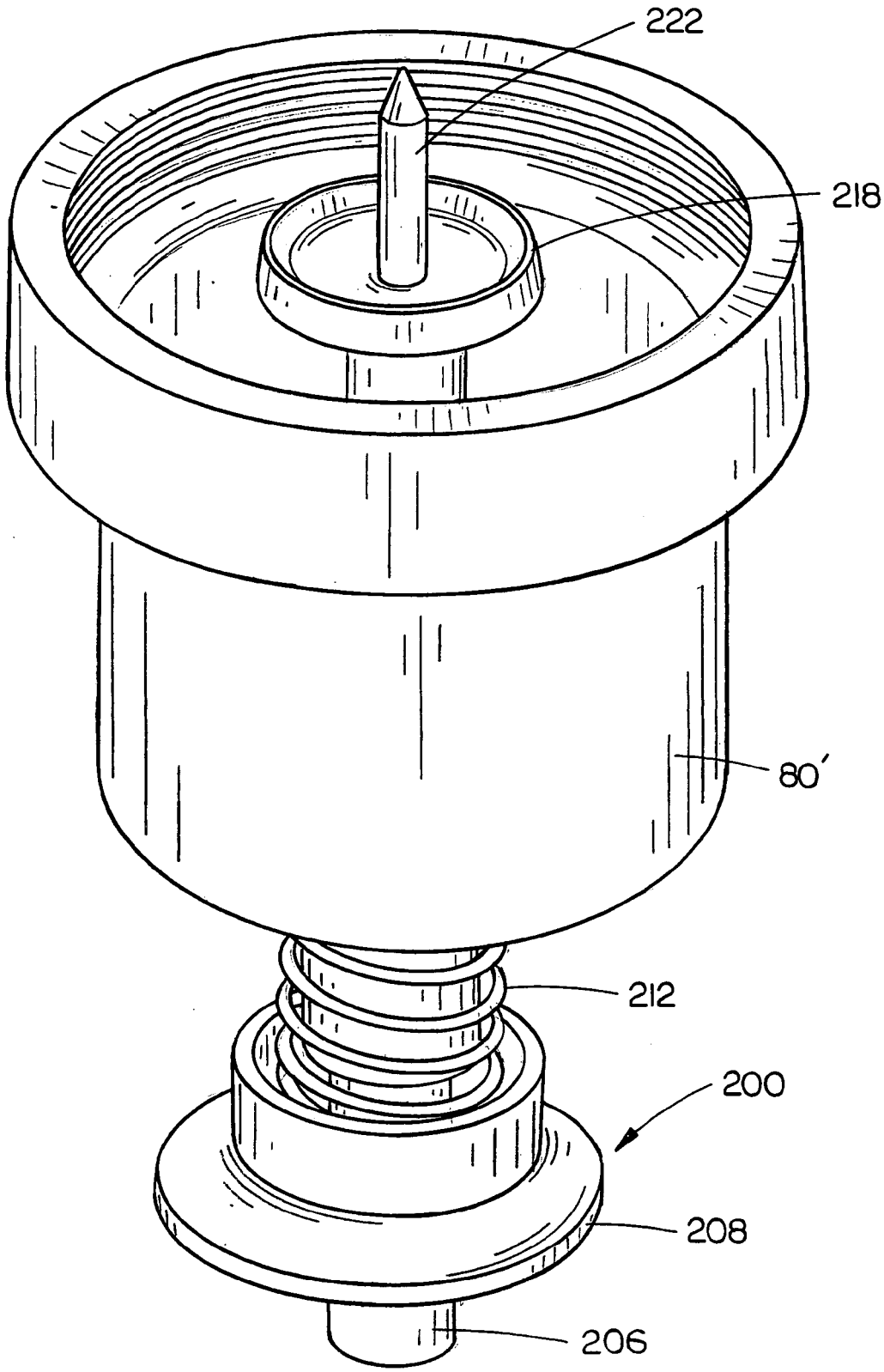
Figure 14:
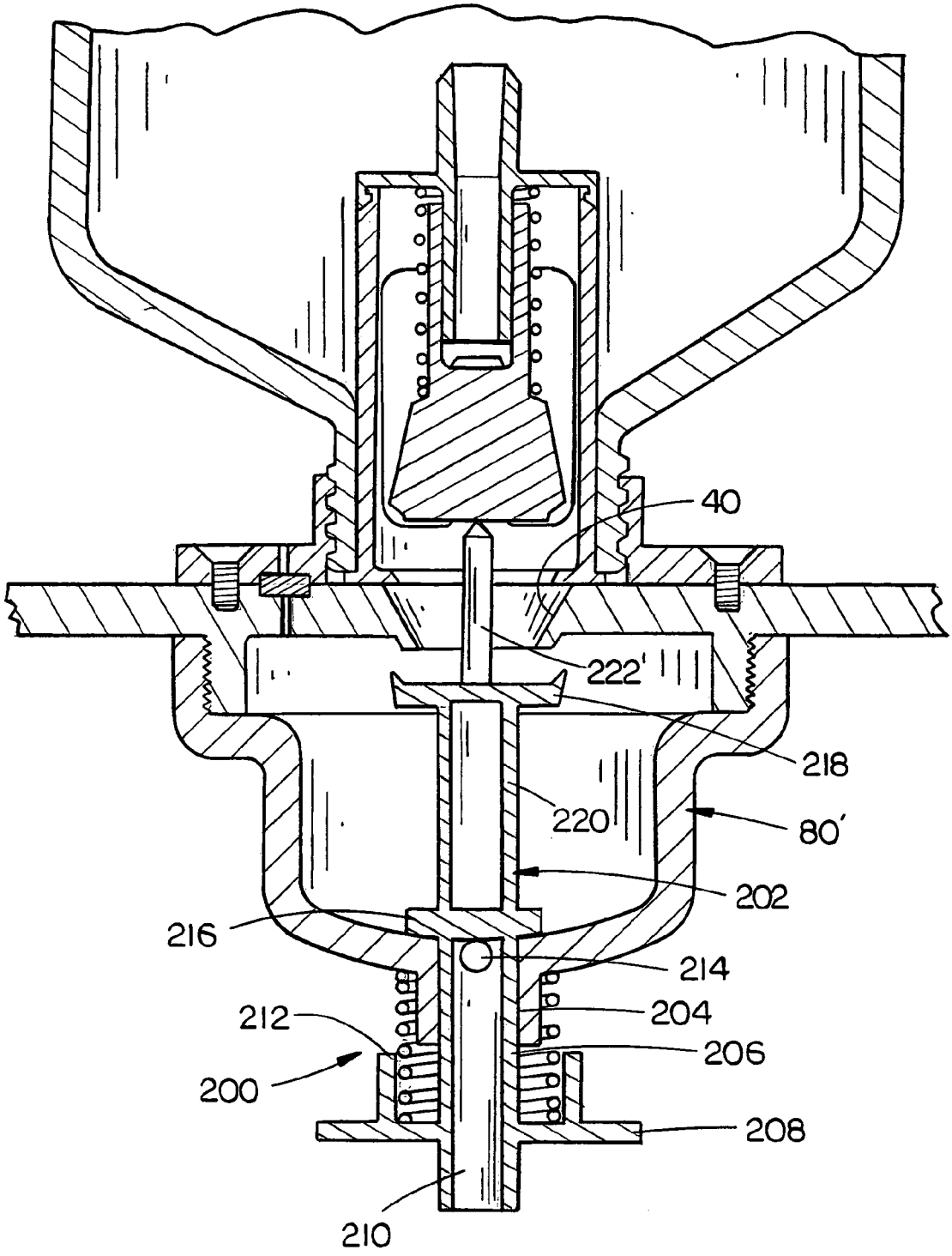

FIGS. 13–14 illustrate an embodiment wherein structure is mounted on the reservoir 80' to enable the apparatus to function as a manual dosing dispenser. In the embodiment of FIGS. 13 and 14, the reservoir 80' will have a predetermined volume such as one ounce, two ounces, etc. The manual dosing structure is designated by the reference numeral 200. Structure 200 includes an elongated valve actuator 202 which is selectively vertically movable within an opening 204 formed in the bottom of the reservoir. Actuator 202 includes a lower tubular portion 206 which is vertically movably received by the opening 204 and which has a laterally extending disc, flange, fingers, etc. referred to generally by the reference numeral 208. Tubular portion 206 is hollow so as to define a passageway 210 extending therethrough. Spring 212 embraces tubular portion 206 between the bottom of reservoir 80' and disc 208 to normally maintain tubular portion 206 in its lower "closed" position of FIG. 14. Tubular portion 206 is provided with one or more openings 214 formed therein which are sealed by the bottom wall of the reservoir 80' when the tubular member is in its lower position (FIG. 14). Shoulder 216 is provided at the upper end of tubular portion 206 to limit the downward movement of the valve actuator 202.

Valve actuator 202 includes a valve member 218 at the upper end of the tubular portion 220, as seen in FIG. 14. Rod 222 is provided at the upper end of actuator 202 for engagement with the valve 46. When the valve actuator 202 is in its lower position, as seen in FIG. 14, the upper end of rod 222 is preferably in engagement with valve 46, to open the same, to enable liquid in the container to fill the dosing reservoir 80'. The liquid cannot drain from the reservoir at this time due to the fact that the opening(s) 214 are sealed.

Assuming that the reservoir 80' is full with the predetermined volume of liquid and it is desired to dispense the same therefrom into a bottle or the like, the open upper end of the bottle is positioned so that the open lower end of tubular portion 206 is received thereby. Upward movement of the member 208 causes valve 218 to seal or close the lower end of valve seat 40, thereby preventing additional liquid from the inverted container from passing downwardly into the reservoir 80'. At the same time, the liquid in the reservoir 80' may flow therefrom through the opening(s) 214 into and through passageway 210 and into the bottle.

When the predetermined liquid dose has been discharged into the receiving bottle, the member 208 is lowered until shoulder 216 engages the bottom of reservoir 80', which seals opening(s) 214. At that time, liquid from the inverted container can then flow around valve 46 into the reservoir for the next dispensing sequence.

Figure 15:
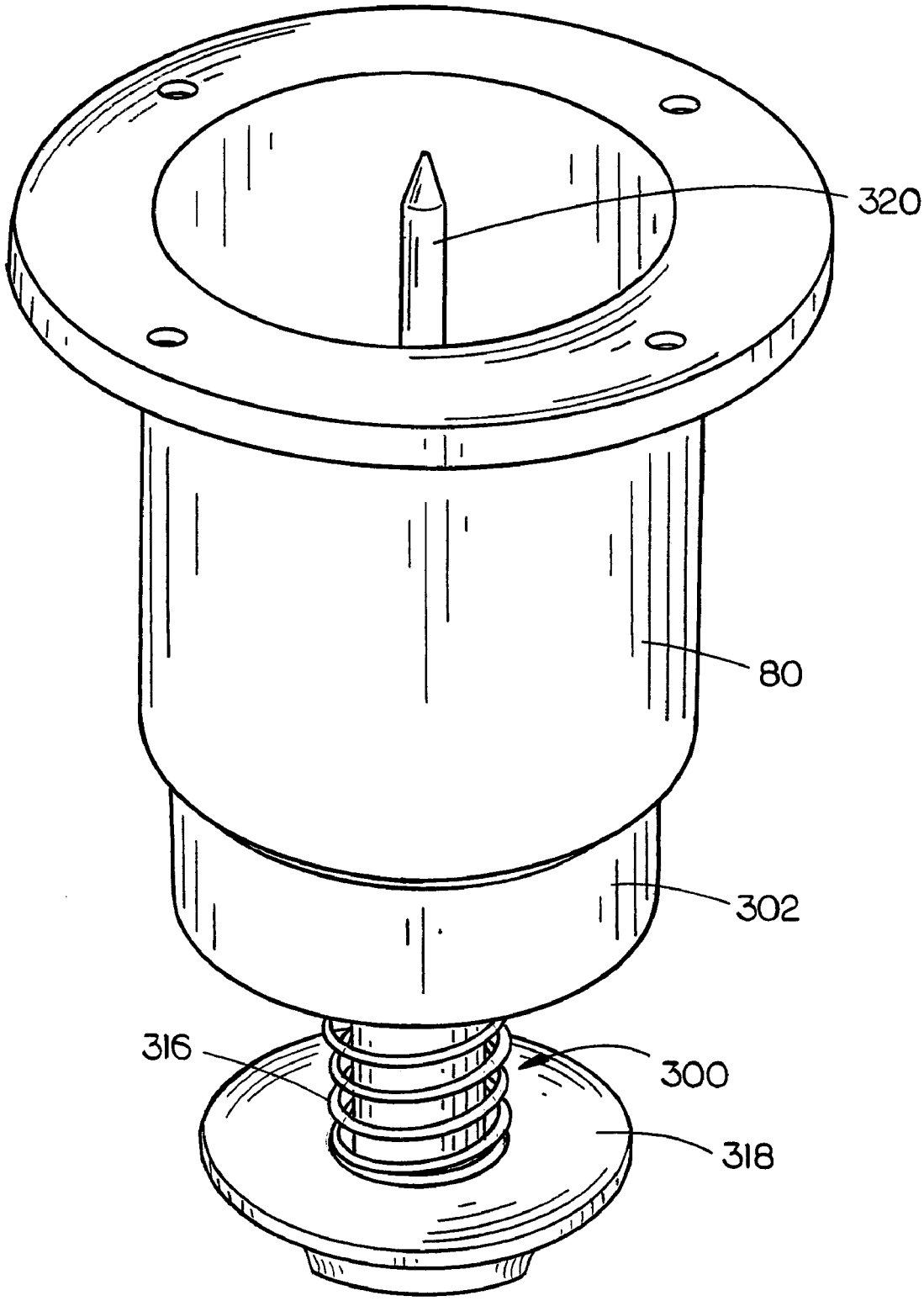
Figure 16:
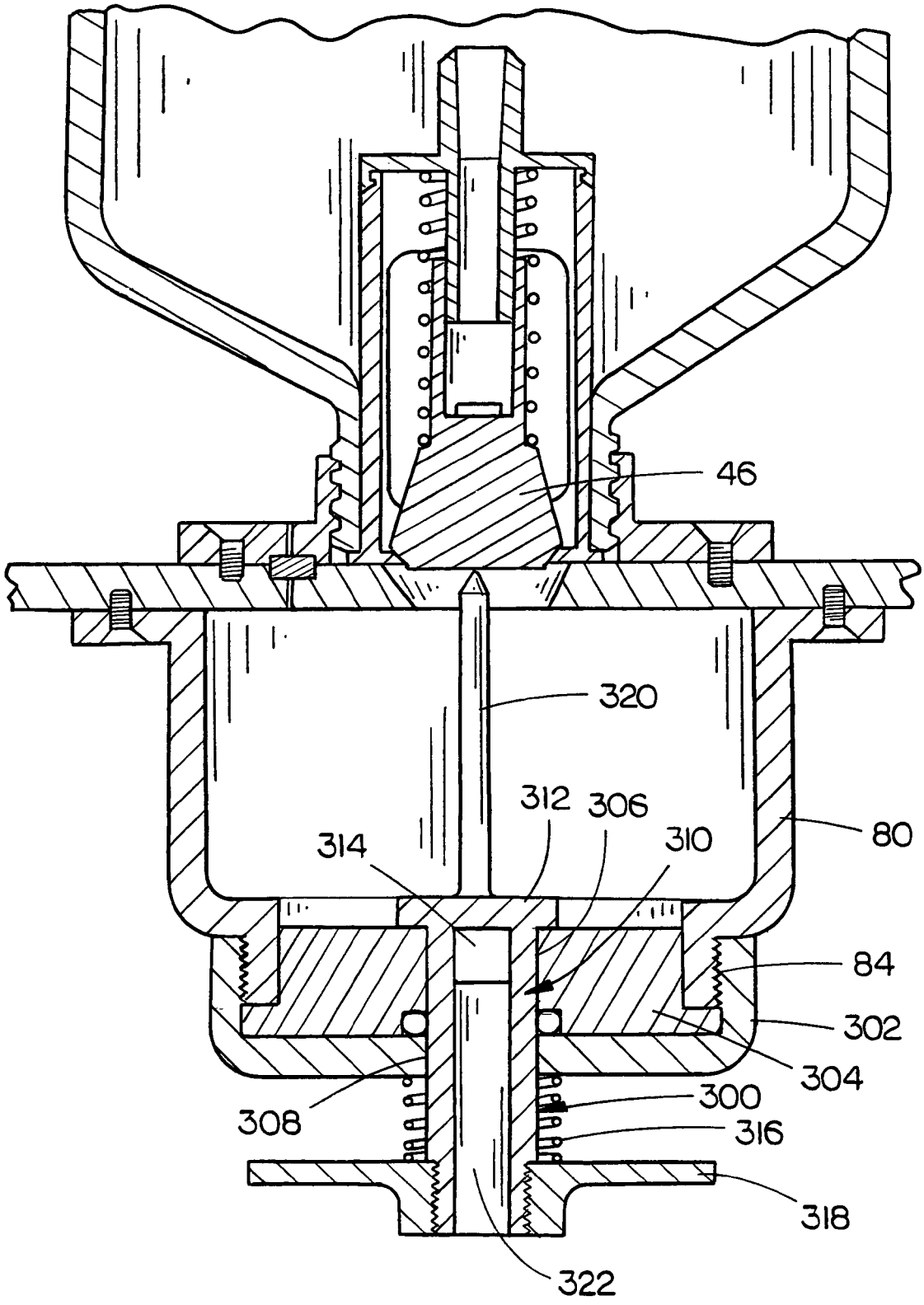
Figure 17:
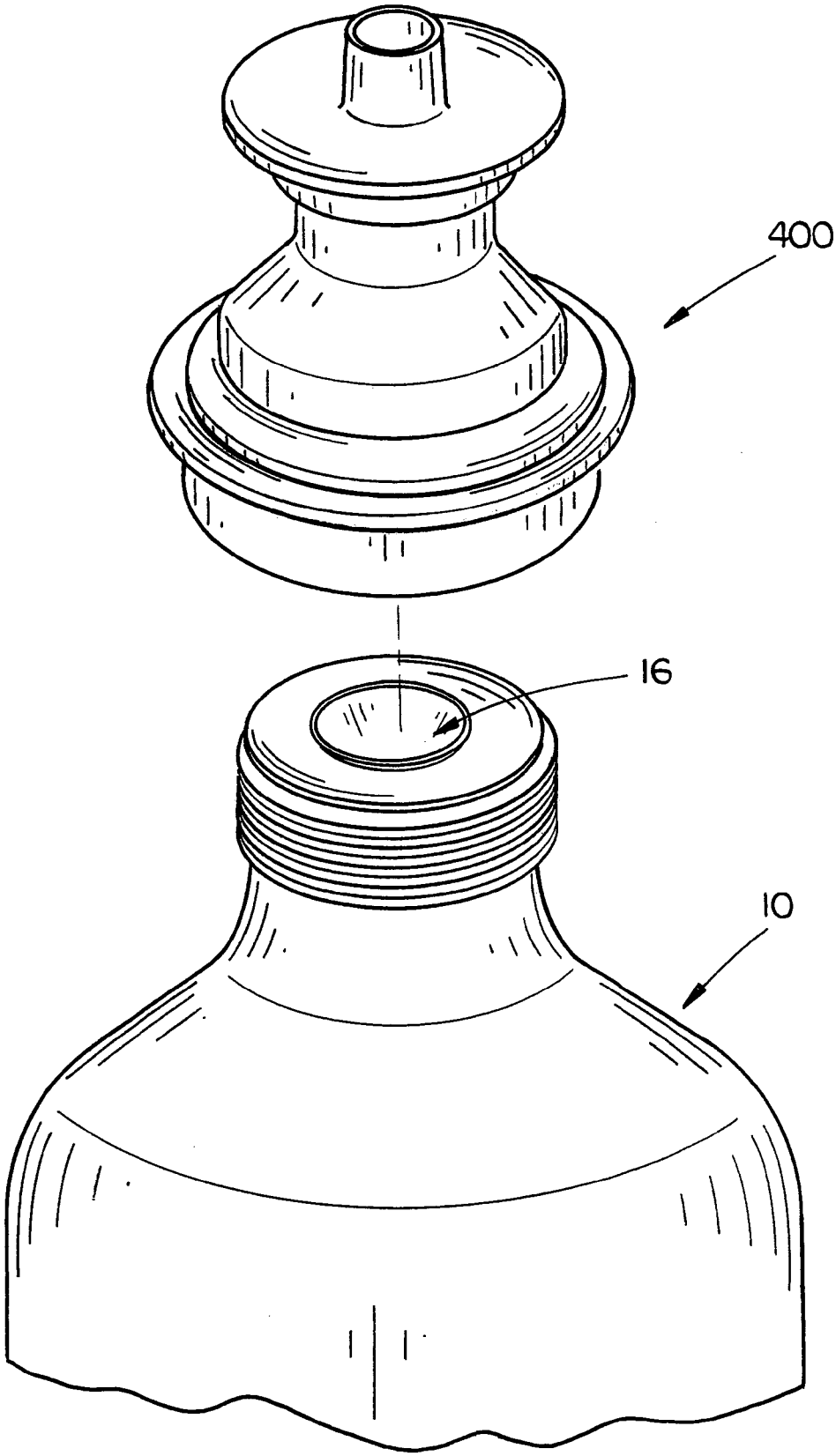
Figure 18:
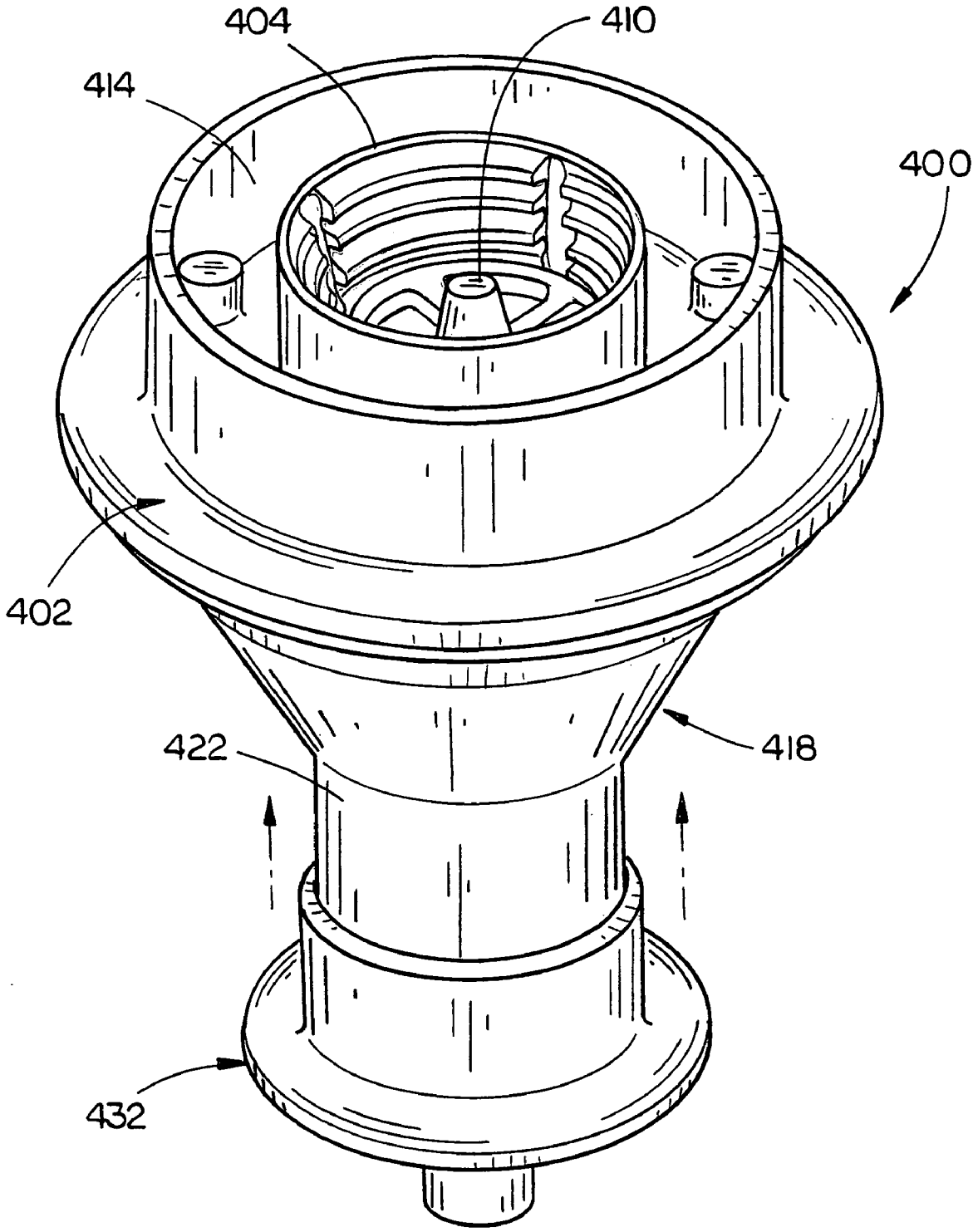

Another dosing dispenser embodiment is illustrated in FIGS. 15 and 16 and includes a valve actuator assembly referred to generally by the reference numeral 300. Assembly 300 includes a cup-shaped cap 302 which is screwed onto the threads 84 of the reservoir 80. Ring block 304 is positioned within cap 302 and has a central opening 306 formed therein which registers with the opening 308 in cap 302. Hollow tubular member 310 is vertically movably received by openings 306 and 308 and has a shoulder or lift valve 312 provided therein which limits the downward movement of tubular member 310 with respect to ring block 304. Tubular member 310 is provided with one or more openings 314 formed therein which are positioned within ring block 304 when the valve actuator is in its lower "closed" position of FIG. 16. Spring 316 embraces tubular member 310 between the bottom of reservoir 80 and a lift lever 318 secured to the lower end of tubular member 310 to yieldably urge the actuator to its lower position. Rod 320 extends upwardly from lift valve 312 and has its upper end positioned closely to the normally closed valve 46 when in the "closed" position of FIG. 16.

When it is desired to fill a bottle or the like with the liquid from the inverted container, the bottle is placed beneath the lift lever 318 and then raised so that rod 320 raises and unseats valve 46 to enable liquid from the container to flow around valve 46, into reservoir 80, through opening(s) 312 which are now exposed above ring block 304, and downwardly through the passageway 322 into the bottle. The bottle is lowered and removed when the desired liquid level in the bottle has been received. As the bottle is lowered, the lift valve 312 seats upon ring block 304 to prevent further liquid from passing through opening 306. Lowering of the lift lever 318 also causes valve 46 to again close.

Although the invention described above is ideally suited for use with a container mounted on a fixture, the invention thereof may be associated with a container which is not mounted on a fixture but which is portable so that the container may be carried from one location to another for use at those locations.

Referring now to the dosing and/or dispensing system or assembly illustrated in FIGS. 17–21, the numeral 400 will be utilized to designate the same. Assembly 400 is also designed to be used with a liquid container 10 having a throat plug assembly mounted therein such as the throat plug assembly 16 illustrated in FIGS. 2 and 3.

Figure 19:
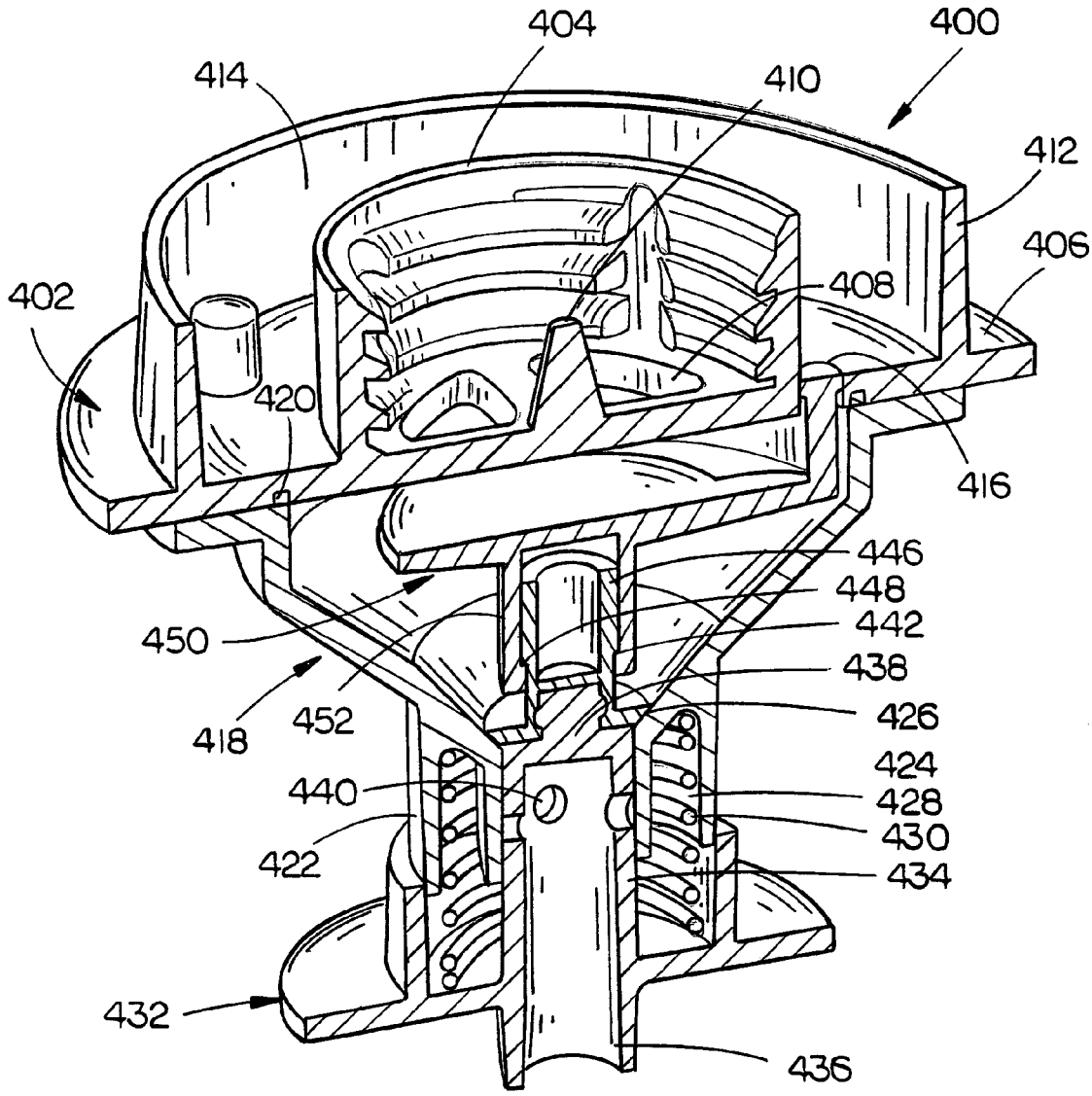
Figure 20:
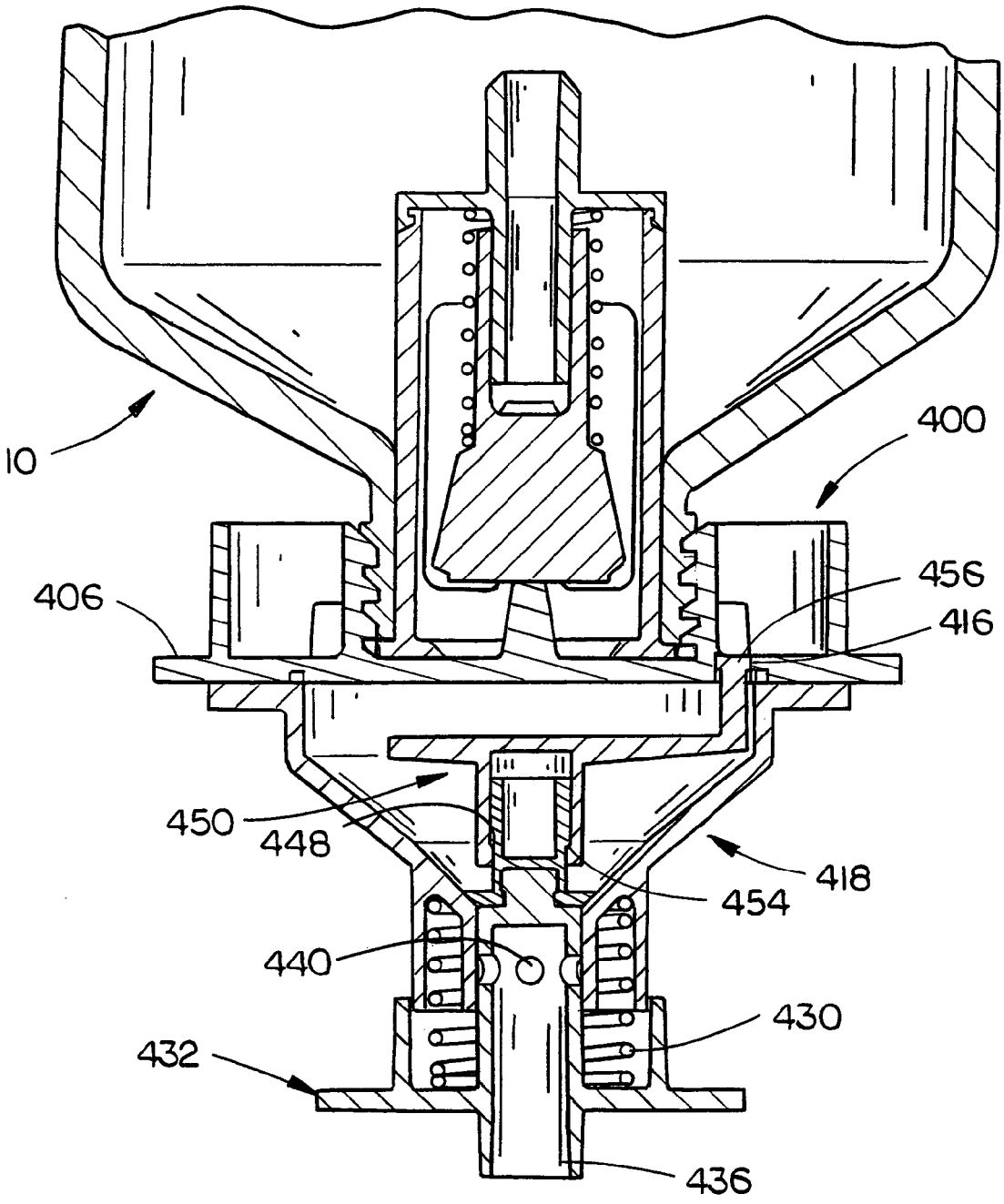
Figure 21:
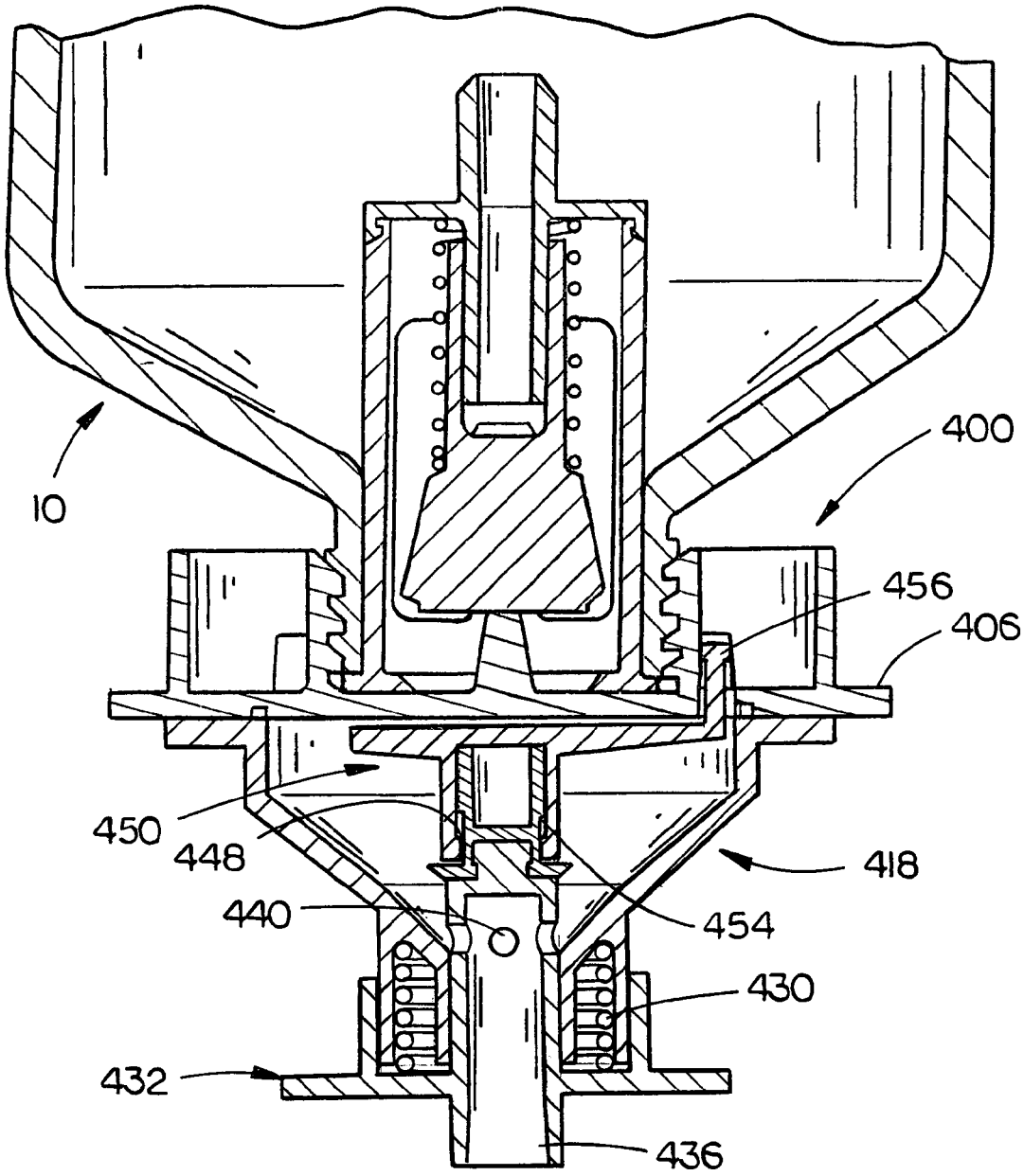

Assembly 400 includes an adapter 402 which is mounted on the container 10 through a threaded connection, a snap-in connection or a snap-on connection. In the embodiment shown in FIGS. 17–21, the adapter 402 is secured to the exterior threads of the container 10. Adapter 402 includes a hollow internally threaded collar 404 which extends upwardly from a disc-shaped base 406 which is provided with openings 408 formed therein within collar 404 (FIG. 19). Post 410 extends upwardly from the base 406 within collar 404, as seen in FIG. 19. As seen in FIG. 19, an annular ring 412 extends upwardly from base 406 outwardly of collar 404 to define a space 414 therebetween. Base 406 is provided with a vent opening 416 outwardly of collar 404.

The numeral 418 designates a hollow cup having its upper end secured to base 406 by any convenient means. Preferably, an O-ring seal 420 is positioned between the upper flanged end of cup 418 and base 406, as seen in FIG. 19. The lower end 422 of cup 418 defines a central opening 424 having a valve seat or valve opening 426 at its upper end. The lower end 422 of cup 418 is also provided with an annular cut-out area 428 which receives the upper end of a spring 430.

A lift valve 432 is selectively movably mounted, between upper and lower positions, on the lower end 422 of cup 418 and is yieldably maintained in its lower position by the spring 430. Lift valve 432 includes a stem portion 434 having an open end 436 and a closed upper end 438. One or more passageways 440 are formed in stem portion 434 below the upper end thereof (FIG. 19). Valve actuator 442 is mounted on the upper end 438 of stem portion 434 and has a valve 444 at its lower end which seats upon and closes valve seat or opening 426 when lift valve 432 is in its lower position. As seen in the drawings, valve actuator 442 includes a tubular portion 446 at its upper end having a shoulder 448 formed therein.

Vent actuator 450 is movably positioned within cup 418 and has a hollow tubular portion 452 slidably mounted on tubular portion 446. Tubular portion 452 is provided with an inwardly presented shoulder 454 which is adapted to engage shoulder 448 at times, as will be described in greater detail hereinafter. Vent actuator 450 includes a vent closure member 456 which is received by vent opening 446 to close the same when lift valve 432 is in its lower position (FIG. 19). When lift valve 432 is in its upper (open) position of FIG. 21, vent closure member 456 is positioned above vent opening 416 so that vent opening 416 is open.

Assuming that adapter 402 has been mounted on the liquid container 10, the container 10 may be inverted without fear that liquid will escape from the container 10 by way of the assembly 400. Liquid from the container 10 will fill the interior of the hollow cup 418 but cannot escape through either the valve seat 426 or the opening 416. Liquid cannot escape from the lower end of the assembly 400 since valve 444 is seated upon and closes valve seat 426 due to the action of spring 430. Liquid cannot escape from vent opening 416 since vent closure member 456 is sealably engaged within opening 416, as seen in FIG. 19.

When it is desired to dispense or dose liquid from the assembly 400, a suitable receptacle such as a bottle or the like is positioned below lift valve 432 so that the open lower end 436 of lift valve 432 is in communication with the bottle. Upward movement of the lift valve 432 against the action of spring 430 causes valve 444 to move upwardly from sealing engagement with valve seat 426 until such time as the openings 440 are positioned above the valve seat 426 at which time the liquid will flow from the interior of the cup 418 into the interior of the stem portion 434 by way of the openings 440.

During the initial upward movement of the lift valve 432, the vent actuator 450 remains in place until the upper end of valve 444 engages the lower end of tubular portion 52 with further upward movement of the lift valve 432 causing the vent actuator 450 to be moved upwardly to cause the vent closure member 456 to move out of the opening 416 to enable ambient air to enter the interior of the cup and then pass upwardly into the container to prevent a vapor lock within the container 10.

When the desired amount of liquid has been dosed or dispensed from the container, the bottle or the like receiving the liquid is moved downwardly so that lift valve 432 may return to its normally lower position. During the initial downward movement of the lift valve 432, the vent actuator 450 remains in position until the shoulder 448 on tubular portion 446 engages the shoulder 454 on tubular portion 452 at which time the continued downward movement of the lift valve 432 will cause vent actuator 450 to move downwardly so that vent closure member 456 again closes vent opening 416.

Figure 22:
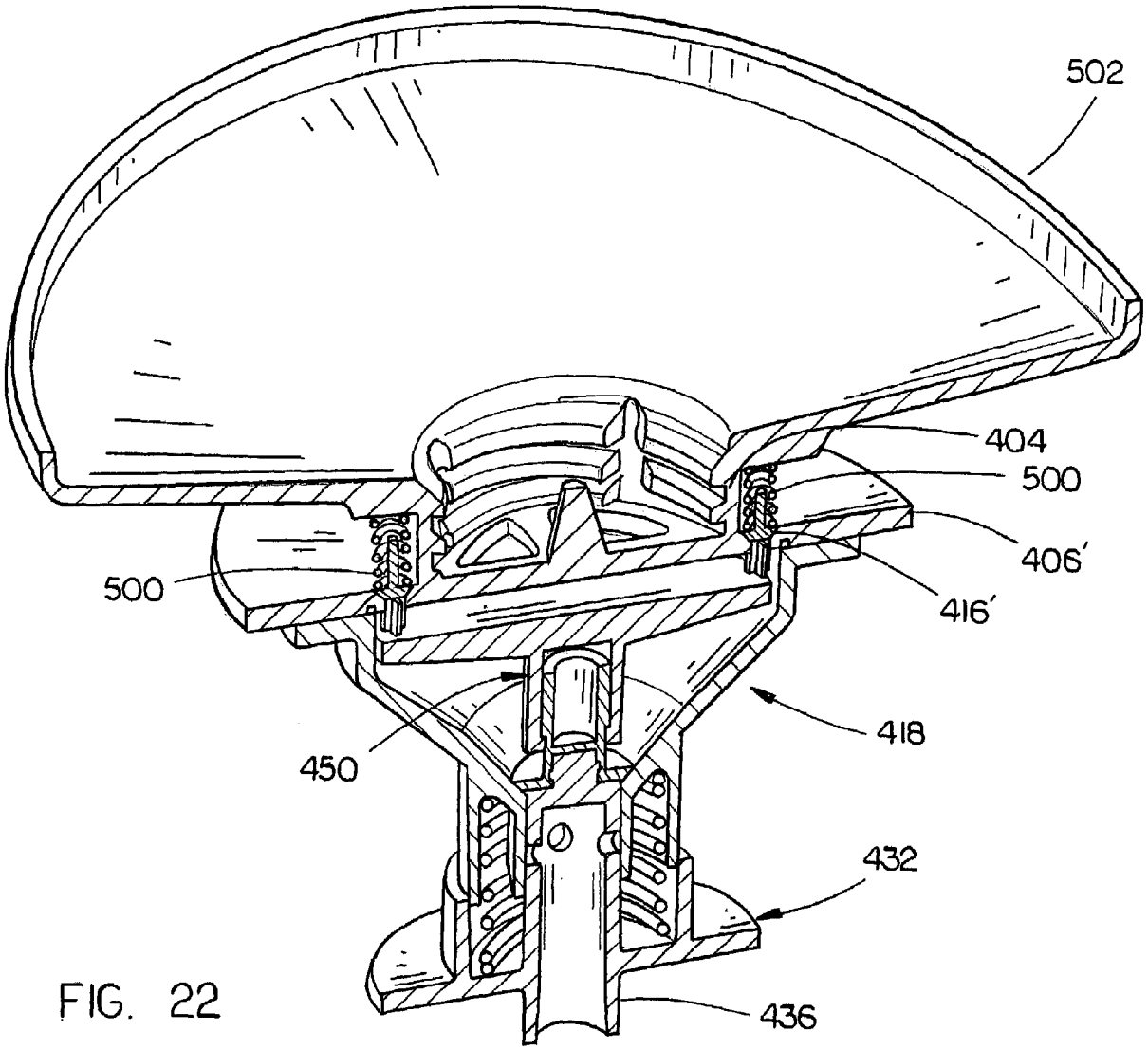
Figure 23:
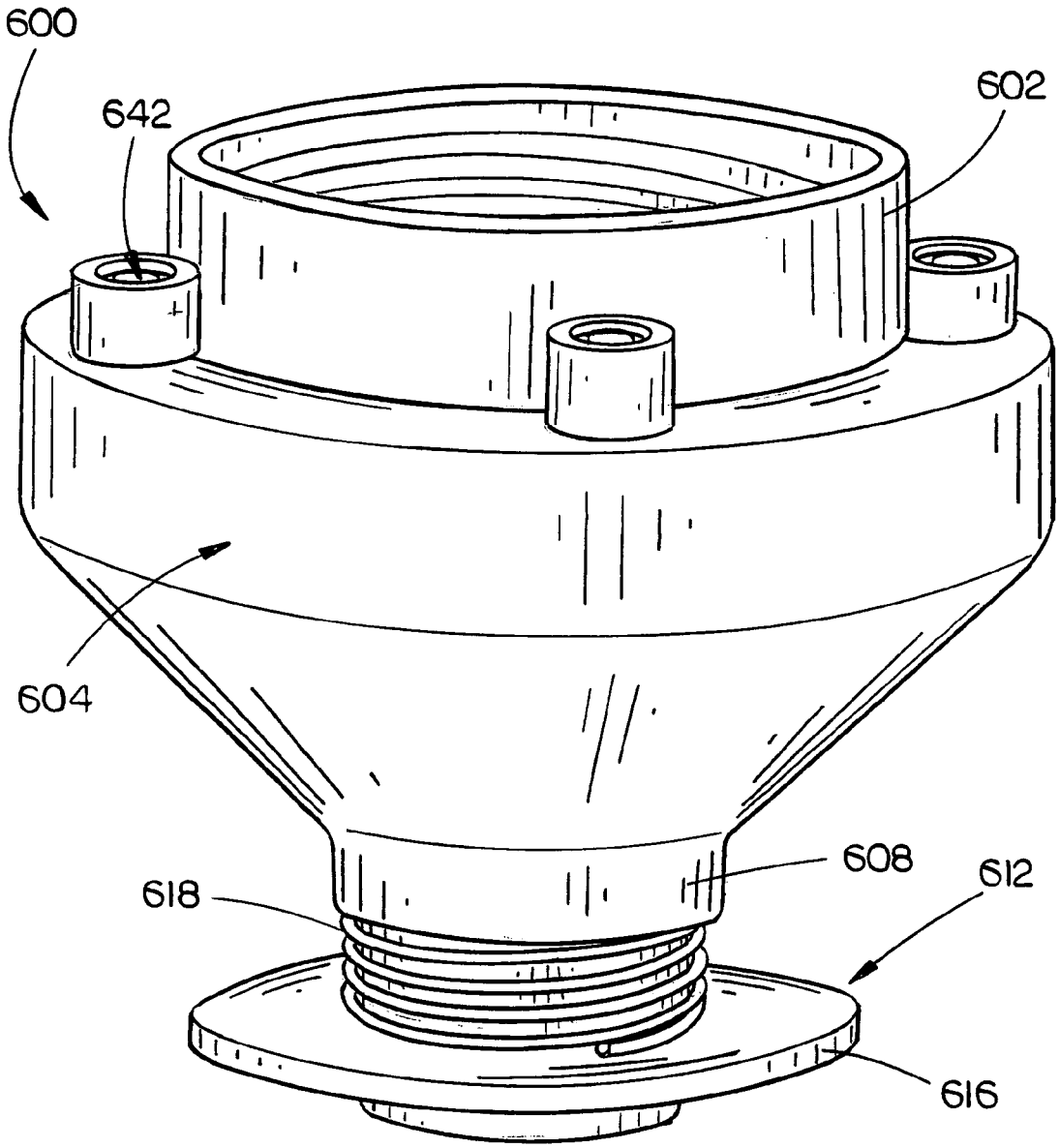
FIG. 23 is a perspective view of the system of this application.

Although the vent closure member 456 satisfactorily closes and opens the vent opening 416, a normally closed, spring-loaded poppet valve 500 may be installed in the opening 416', as illustrated in FIG. 22. As seen in FIG. 22, the lower end of the poppet valve 500 is positioned below the base 406'. Sufficient upward movement of the vent actuator 450' causes the poppet valve 500 to be moved upwardly with respect to the vent opening 416' to open the same. As seen, one or more of the poppet valves 500 may be utilized to ensure proper venting. In FIG. 22, the numeral 502 refers to a catch tray which extends outwardly from the upper end of collar 404 to catch any liquid spills.

Figure 24:
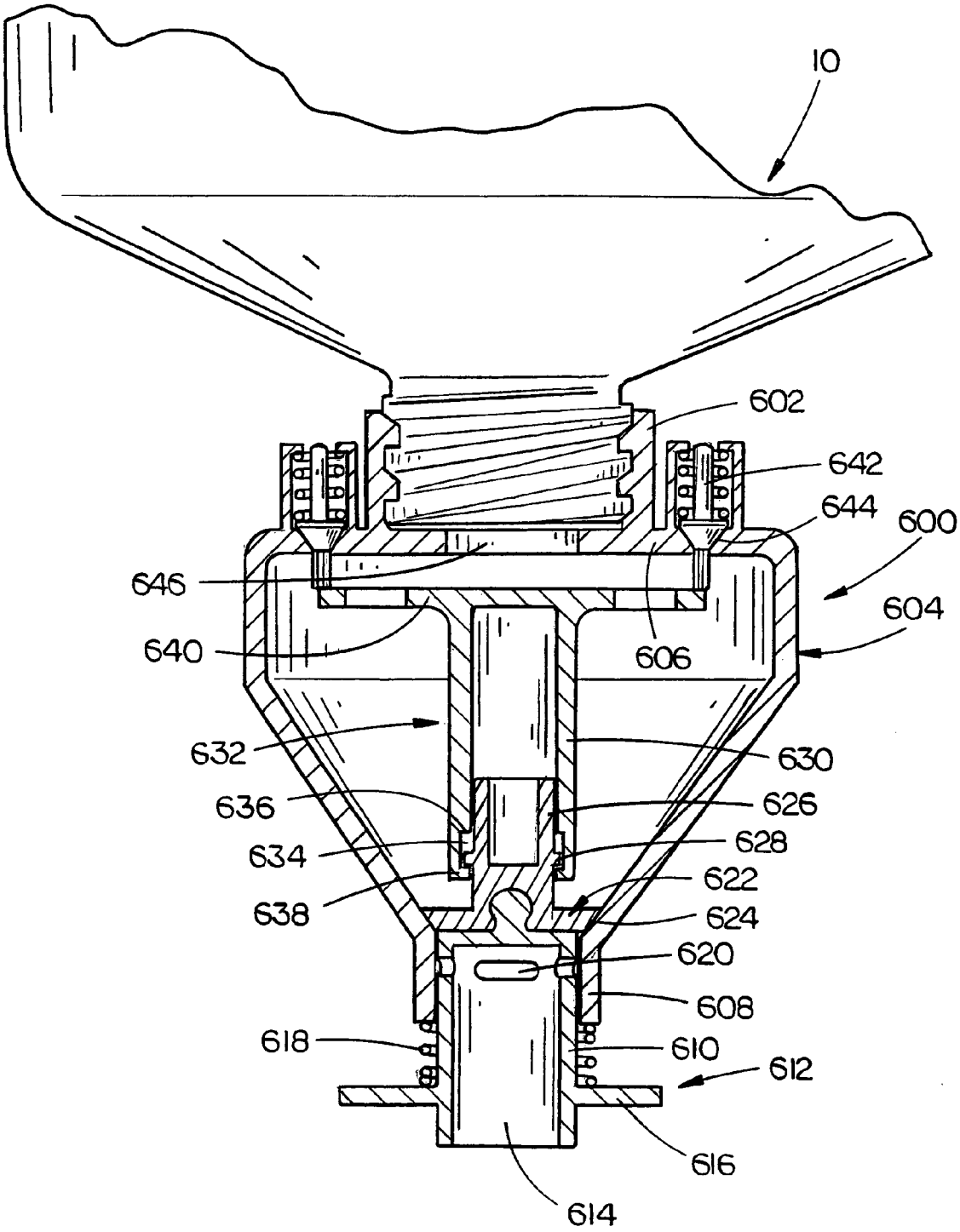
FIG. 24 is a vertical sectional view of the system of FIG. 23.
Figure 25:
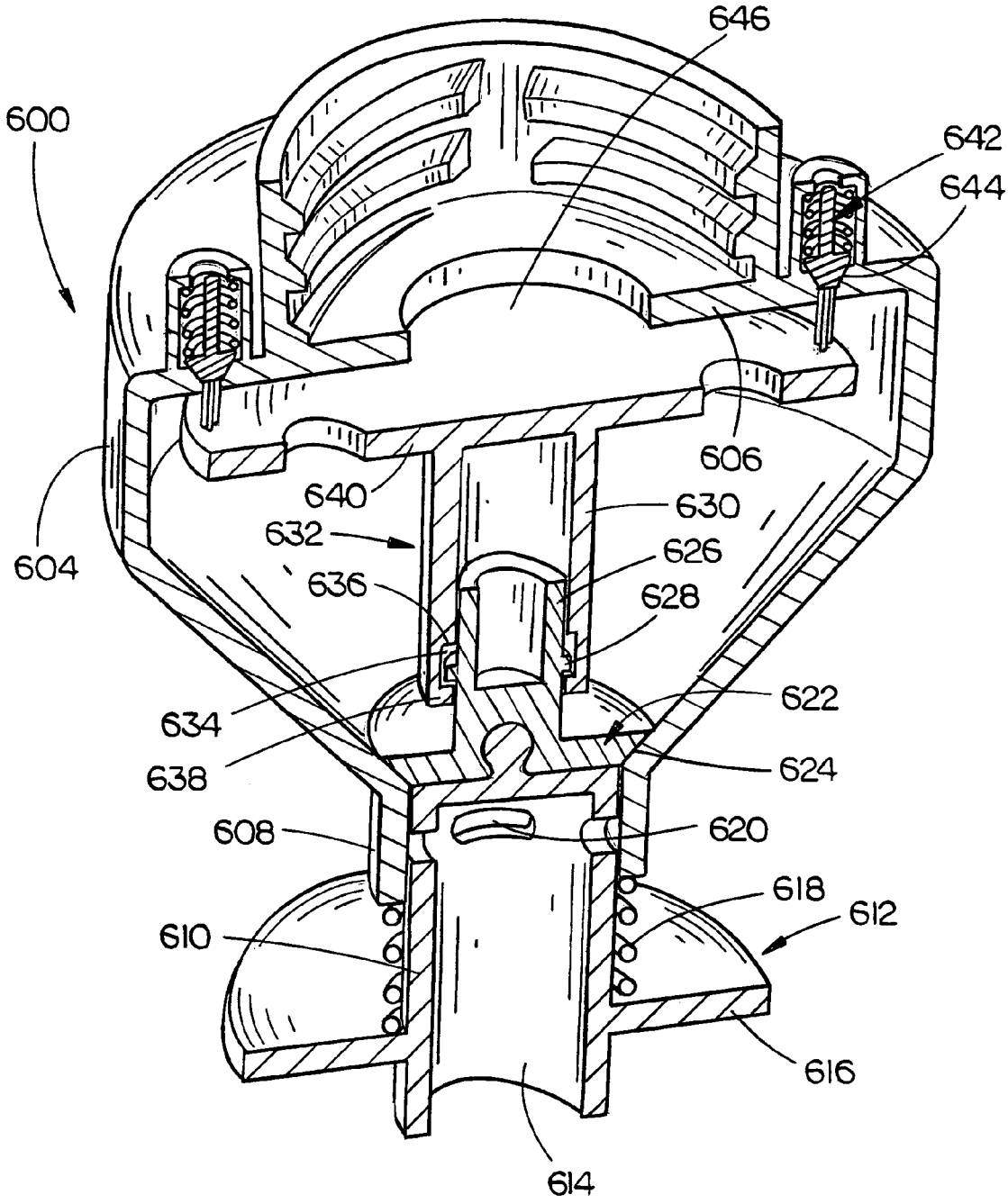
FIG. 25 is a perspective sectional view of the system of FIG. 23.
Figure 26:
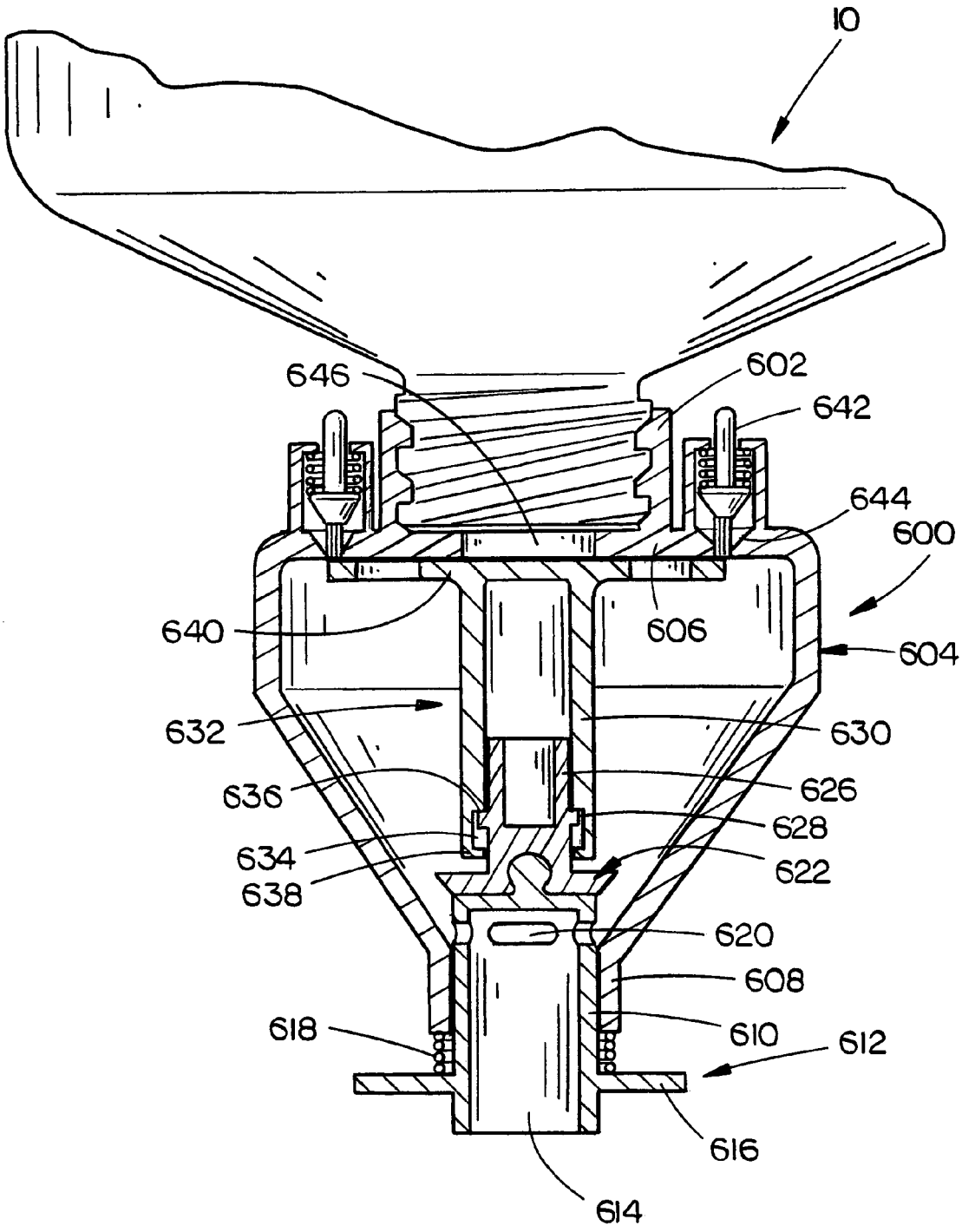
FIG. 26 is a sectional view similar to FIG. 24 except that the system is shown in its dosing and/or dispensing position.

FIGS. 23–26 illustrate the embodiment of the instant invention. The system disclosed in FIGS. 24–26 is designed so as to eliminate the need for a throat plug assembly being inserted into the throat of the container. The numeral 600 will be utilized to refer to the dosing and/or dispensing system or assembly illustrated in FIGS. 24–26. Assembly 600 is also designed to be used with a liquid container 10, but the system of this invention eliminates the need for a throat plug assembly to be mounted in the container, as previously stated. Assembly 600 includes connector 602 which extends upwardly from cup 604 and which is adapted to be secured to the container 10 through a threaded connection, a snap-in connection or a snap-on connection. In the embodiment shown in FIGS. 24–26, the connector 602 is threadably secured to the exterior threads of the container 10. Hollow cup 604 has its upper end or top wall 606 integrally formed with the connector 602. Cup 604 also includes a tubular lower end portion 608 which slidably receives stem portion 610 of lift valve 612. Lift valve 612 has an open lower end 614 and a laterally extending lift arm or disk 616 provided thereon, as seen in FIG. 24. Spring 18 is positioned between the upper end of lift arm 616 and the lower end of lower end portion 608 to yieldably urge the lift valve to its lowermost enclosed position. The upper end of stem portion 610 is provided with one or more passageways 620 formed therein below the closed upper end thereof, as also best seen in FIG. 24. Valve 622 is mounted on the upper end of lift valve 612, as illustrated in FIG. 24, and is adapted to sealably engage the inside wall surface or valve seat 624 to sealably close the lower end of cup 604 when the lift valve 612 is in its lowermost position. Valve 622 includes an upwardly extending tubular portion 626 having a radially extending shoulder 628 extending outwardly therefrom. Tubular portion 628 is slidably received within tubular portion 630 of vent actuator 632 (FIG. 24). The inside lower wall surface of tubular portion 630 is provided with a recessed area 634 which receives the shoulder 628 of valve 622. Recess 634 defines an upper shoulder 636 and a lower shoulder 638.

The upper end of tubular portion 630 of valve actuator 632 is provided within an upper end portion, top wall or flat plate 640 having an opening 646 formed therein. One or more spring-loaded poppet valves 642 are movably mounted in the upper end portion 606 of cup 604 which normally seal vent openings 644 in cup 604. As seen, the lower ends of the poppet valves are positioned below the top wall 606.

When the lift valve 612 is in its lowermost position of FIG. 24, the poppet valves 642 close the vent openings 644. When lift valve 612 is moved towards its uppermost position, the shoulder 628 engages shoulder 636 to move actuator 630 upwardly which causes the top wall 640 to engage the lower ends of the poppet valves 642 to move the poppet valves 642 to their open position to permit ambient air to enter the interior of the cup 604 and to travel into the interior of the container 10 to prevent vapor locks. When lift valve 612 is in its uppermost position (FIG. 26), the flat plate 640 seals the opening 646. When lift valve 612 is moved from its uppermost position to its lowermost position, the shoulder 628 engages the shoulder 638 to pull the actuator 630 downwardly so that the poppet valves 642 may then move to their closed positions.

The assembly of this invention may be mounted on the container 10 without the use of a throat plug assembly as in the previous embodiments disclosed herein. The container 10 is initially placed in an upright condition and the assembly 600 is then connected to the container. The container 10 is then inverted so that liquid within the container may flow downwardly into the interior of the cup 604. If the assembly is going to be used for dosing, the interior compartment of the cup 604 will have a predetermined volume so only that volume will be dispensed. Assuming that the connector 602 has been mounted on the liquid container 10, the container 10 may be inverted without fear that liquid will escape from the container 10 by way of the assembly 600. Liquid from the container 10 will fill the interior of the hollow cup 604 but cannot escape through either the valve seat 624 or the openings 620. Liquid cannot escape from the lower end of the assembly 600 since valve 622 is seated upon and closes valve seat 624 due to the action of the spring 618. Liquid cannot escape from vent openings 644 since the poppet valves 642 are in their closed position.

When it is desired to dispense or dose liquid from the assembly 600, a suitable receptacle such as a bottle or the like is positioned below lift valve 612 so that lower open end 614 of lift valve 612 is in communication with the bottle. Either downward movement of the lift valve 612 against the action of the spring 618 with the lift arm 616 being in contact with the upper end of the bottle or upward movement of the bottle with respect to the assembly 600 will cause valve 622 to unseat from valve seat 624 and will cause the opening 620 to be positioned above the lower end portion 608 of cup 604 so that liquid within the cup 604 may flow into the interior of the stem portion 610 of lift valve 612 by way of the opening 620 and thence downwardly through the open end of the lift valve.

The movement of the lift valve 612 towards its uppermost position relative to the cup 604 causes the vent opening 644 to be opened so that ambient air may enter the interior of the cup and the container to prevent vapor locks. Further upward movement of the lift valve causes flat plate 640 to seal the opening 649 to prevent further liquid from the container 10 from passing into the cup 604 so that the assembly may be used as a dosing system. If the operator simply wants to dispense liquid from the container into the cup 604 and outwardly therefrom, the lift valve 612 is not moved to its fully upper position so that the top wall 640 will not seal the opening 646.

When the desired amount of liquid has been dosed and dispensed from the container, the bottle or the like receiving the liquid is moved downwardly so that the lift valve 612 may return to its normally lower position. The assembly 600 may be conveniently secured to a bracket mounted on a wall, golf cart, etc., or may be used in a completely portable fashion by simply leaving the assembly 600 on the container and moving the container from location to location.

Thus it can be seen that the invention accomplishes at least all of its stated objectives.

I claim:

1. In combination:

an inverted liquid container having upper and lower ends;

said lower end of said container having a hollow throat extending downwardly therefrom;

a hollow cup having upper and lower ends;

a connector on the upper end of said cup which is selectively secured to the throat of the container;

said upper end of said cup having a central opening formed therein which is in communication with said connector;

said upper end of said cup having at least one vent opening formed therein which is in communication with ambient air;

a valve normally closing said vent opening;

said cup having a valve opening formed therein above its lower end;

said cup having a central opening formed in its said lower end below said valve opening;

a lift valve, having upper and lower ends, vertically movably mounted on said lower end of said cup which is movable between upper and lower positions;

said lift valve having a valve stem which is slidably received by said central opening in said lower end of said cup;

said valve stem having a closed upper end and an open lower end;

said valve stem having at least one liquid passageway formed therein below its said closed upper end;

a valve on said valve stem of said lift valve which closes said valve opening when said lift valve is in its said lower position;

said liquid passageway being positioned below said valve opening when said lift valve is in its said lower position;

said liquid passageway being positioned above said valve opening when said lift valve is in its said upper position;

a vent actuator operatively secured to said lift valve above said valve opening for movement therewith;

said vent actuator being movable between upper and lower positions;

said valve means closing said vent opening when said vent actuator is in its said lower position;

said valve means causing said vent opening to be open when said vent actuator is in its said upper position.

2. The combination of claim 1 wherein a spring urges said lift valve towards its said lower position.

3. The combination of claim 1 wherein said vent actuator includes a first hollow tubular portion which slidably embraces a second tubular portion on said upper end of said lift valve.

4. The combination of claim 3 wherein said first tubular portion has inner and outer surfaces and wherein said second tubular portion has an outer surface; said inner surface of said first tubular portion having a recess formed therein which defines upper and lower shoulders; said outer surface of said second tubular portion having an outwardly presented shoulder that is received by said recess.

5. The combination of claim 4 wherein said shoulders permit a predetermined amount of upward movement of said lift valve with respect to said vent actuator without said valve means moving out of engagement with said vent opening.

6. In combination:

an inverted liquid container having upper and lower ends;

said lower end of said container having a hollow throat extending downwardly therefrom;

a hollow cup having upper and lower ends;

said hollow cup being secured to said container and having an opening formed in its upper end which communicates with the interior of said container;

said upper end of said cup having a vent opening formed therein which is in communication with ambient air;

a normally closed valve positioned in said vent opening;

said cup having a valve opening formed therein above its lower end;

said cup having a central opening formed in its said lower end below said valve opening;

a lift valve, having upper and lower ends, vertically movably mounted on said lower end of said cup which is movable between upper and lower positions;

said lift valve having a valve stem which is slidably received by said central opening in said lower end of said cup;

said valve stem having a closed upper end and an open lower end;

said valve stem having a liquid passageway formed therein below its said closed upper end;

a valve on said lift valve which closes said valve opening when said lift valve is in its said lower position;

said liquid passageway being positioned below said valve opening when said lift valve is in its said lower position and which is positioned above said valve opening when said lift valve is in its said upper position;

a vent actuator operatively secured to said lift valve for movement therewith above said valve opening;

said vent actuator being movable between upper and lower positions;

said vent actuator engaging said valve to open said valve when said vent actuator is in its said upper position.

7. The combination of claim 6 wherein a spring urges said lift valve towards its said lower position.

8. The combination of claim 6 wherein said vent actuator includes a first hollow tubular portion which slidably embraces a second tubular portion on said upper end of said lift valve.

9. The combination of claim 6 wherein said vent actuator also closes said opening in said upper end thereof when said lift valve is in its said upper position.

* * * * *